US006603935B2

(12) United States Patent
Tsuruya et al.

(10) Patent No.: US 6,603,935 B2
(45) Date of Patent: Aug. 5, 2003

(54) IMAGE FORMING APPARATUS FEATURING APPLICATION OF SUPERIMPOSED DC AND AC VOLTAGES AND DC VOLTAGE

(75) Inventors: Satoshi Tsuruya, Shizuoka (JP); Katsuhiro Sakaizawa, Shizuoka (JP); Jun Suzuki, Shizuoka (JP); Masaru Shimura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,413

(22) Filed: Jan. 30, 2002

(65) Prior Publication Data

US 2002/0159782 A1 Oct. 31, 2002

(30) Foreign Application Priority Data

Feb. 1, 2001 (JP) ..... 2001-025587

(51) Int. Cl.[7] ..... G03G 15/00; G03G 15/02
(52) U.S. Cl. ..... 399/50; 399/150; 399/176
(58) Field of Search ..... 399/149, 150, 399/168, 169, 174, 175, 176, 100, 343

(56) References Cited

U.S. PATENT DOCUMENTS 5,835,821 A 11/1998 Suzuki et al. ..... 399/100
6,038,420 A * 3/2000 Hirabayashi et al. ..... 399/176
6,128,456 A 10/2000 Chigono et al. ..... 399/176
6,226,480 B1 * 5/2001 Hirabayashi et al. ... 399/149 X
2002/0039498 A1 * 4/2002 Suzuki et al. ..... 399/149
2002/0048468 A1 * 4/2002 Sakaizawa et al. ..... 399/150

FOREIGN PATENT DOCUMENTS

JP 09-096997 * 4/1997
JP 11-149205 * 6/1999

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member, a flexible changing member and a developing device. When a first area to be an image forming area of the image bearing member, is present in a nip portion, a superimposed voltage resulting from a direct current voltage and an alternating voltage having a peak to peak voltage smaller than an alternating voltage applied when a charging potential of the image bearing member is converged is applied to the charging member. When a part of a second area to be a non-image area of the image bearing member exists in the nip portion, a direct current voltage without an alternating voltage is applied to the charging member.

21 Claims, 11 Drawing Sheets

$$SF-1=\frac{(MXLNG)^2}{AREA}\times\frac{\pi}{4}\times 100$$

$$SF-2=\frac{(PERI)^2}{AREA}\times\frac{1}{4\pi}\times 100$$

IMAGE FORMING APPARATUS FEATURING APPLICATION OF SUPERIMPOSED DC AND AC VOLTAGES AND DC VOLTAGE

BACKGROUND OF THE INVENTION

1. Field of the Invention

The present invention relates to an image forming apparatus such as a laser printer, a copying machine or a facsimile of a contact charging system in which an image bearing member such as an electrophotographic photosensitive body or an electrographic recording dielectric is uniformly charged with a predetermined polarity and potential.

2. Related Art

An explanation will be made giving an example of an image forming apparatus utilizing an electrophotographic system. Conventionally, there has been an image forming apparatus called "cleaning simultaneous with developing" or "cleanerless" in which arrangement of a cleaning means as a dedicated device is eliminated by making a developing means also serve as a cleaning means for toner remaining on a surface of a photosensitive drum (hereinafter referred to as transfer residual toner) after a toner image transfer with respect to a transferring material for attaining the effect of reducing the whole apparatus in size, dealing with ecology with no occurrence of waste toner, the effect of lengthening life of an electrophotographic photosensitive body (hereinafter referred to as photosensitive drum) that is an image bearing member, and reduction of a consumption amount of toner that is a developer per one page.

There is disclosed in, for example, U.S. Pat. No. 6,128,456 the above-mentioned image forming apparatus, which is sometimes called "cleaning simultaneous with developing" or a "cleanerless" apparatus in which a charging means of a direct charging system with no use of discharge is used as a charging process means of the photosensitive drum.

In this image forming apparatus, conductive charge accelerating particles are interposed in a contact portion of a contact charging means (contact charging member) contacting the photosensitive drum and the photosensitive drum, and only a direct current voltage is applied, thereby obtaining a surface potential of the photosensitive drum which is substantially equal to the applied direct current voltage.

This system does not positively use discharge, and thus, there is no occurrence of ozone. Further, in this system, adhesion of a discharge product to the photosensitive drum can be suppressed, and the problem of smeared image (image flow) and the like under high temperature and high humidity environment is prevented.

However, in the above-mentioned image forming apparatus of the cleaning simultaneous with developing system which is provided with the charging means using the direct charging system has had the following problem.

In case of using the direct charging system charging means disclosed in U.S. Pat. No. 6,128,456, there is a case where, as the number of sheets to be passed increases, the transfer residual toner stuck to the contact charging means is accumulated, and thus, the contact charging means is contaminated, which leads to charging defect that causes image defect.

This phenomenon occurs because the transfer residual toner stuck to the contact charging means is not electrostatically expelled since the direct current voltage applied to the contact charging means and the charging potential of the surface of the photosensitive drum are substantially equal to each other. In particular, in the case where the structure is adopted in which the transfer residual toner is positively scraped from the photosensitive drum by providing speed difference between the photosensitive drum and the contact charging means, the above-mentioned image defect is conspicuous.

The present inventors make a proposal for the method of solving the above problem while making use of the merit of direct charging in which discharge is not positively used in U.S. patent application Ser. No. 09/921,700.

This proposal is characterized in that cleaning supporting particles as conductive particles with the purpose of accelerating charging are interposed in a contact portion of a contact charging means (charging cleaning member) and a photosensitive drum that is an image bearing member, and that an alternating voltage with a peak to peak voltage of 500 V or higher and below a charging potential convergence voltage is superimposed on and applied to a direct current voltage at the time of image formation.

In more detail, the cleaning supporting particles having a particle resistance of $10^{12}$ Ω·cm or less are interposed in the contact portion of the contact charging means, which charges the photosensitive drum as the image bearing member, which has flexibility, and of which at least an outer peripheral surface is porous, and the photosensitive drum, and the alternating voltage is superimposed and applied at the time of image formation. Thus, the contact charging means scrapes the toner that is the developer remaining on the photosensitive drum after transfer. Also, the toner stuck to the contact charging means does not become to have positive polarity since it is not influenced by discharge, and the toner does not remain on the contact charging means and can be expelled to the downstream side in a rotational direction of the photosensitive drum due to the potential difference between the contact charging means and the surface of the photosensitive drum.

Further, in the case where only the direct current voltage is applied, the surface of the photosensitive drum is uniformly charged without unevenness at a predetermined potential, with the result that charging in which direct injection charging is dominant can be realized.

Here, the contact charging means is driven with the speed difference with respect to the photosensitive drum. Thus, the scraping property of the residual toner is improved, and the stable charging property can be obtained.

Furthermore, the above is combined with an action of the cleaning supporting particles with a particle size of 0.1 to 3 μm which exist on the contact charging means. Thus, the toner stuck to the contact charging means can be effectively expelled.

Therefore, by taking the structure proposed in U.S. patent application Ser. No. 09/921,700, an alternating electric field suitable for expelling the toner that is the developer from the contact charging means is formed. Thus, it is possible to prevent contamination of the contact charging means over a long period of time, thereby obtaining the stable charging property.

On the other hand, cleaning simultaneous with developing is conducted by using a contact developing means in which a developer carrying member contacts the photosensitive drum. Thus, output images with high quality and with little fog can be obtained over a long period of time without an influence of deflection of the charging potential. Moreover, the transfer efficiency is improved by using spherical toner, and thus, the toner remaining on the photosensitive drum after transfer can be reduced. At the same time, expelling at the time when the toner is stuck to the contact charging means becomes easy. The proposal is made such that stabilization of a cleanerless system can be attained over a long period of time.

However, in the proposal in U.S. patent application Ser. No. 09/921,700, it is found out that the following disadvantage is seen in the case where specific pattern images are continuously formed particularly in low temperature and low humidity environment.

As described above, when the alternating voltage is superimposed and applied at the time of image formation, the porous contact charging means expels the scraped transfer residual toner to the downstream side in the rotational direction of the photosensitive drum simultaneously with the cleaning supporting particles interposed in the contact portion of the photosensitive drum and the contact charging means.

The cleaning supporting particles are interposed in the contact nip portion of the photosensitive drum and the contact charging means, and are low resistance particles essential for stably maintaining the charging in which direct injection charging is dominant. The particles are interposed in the nip portion even if the contact charging means is somewhat contaminated by the toner. Thus, the surface of the photosensitive drum can be uniformly charged without unevenness at a predetermined potential. However, in the case where the amount of interposal of the particles becomes a predetermined amount or less with respect to the amount of contamination due to toner, it is difficult to secure charging uniformity.

In particular, when images of a longitudinal belt pattern or the like are continuously formed in the low temperature and low humidity environment in which securing charging property is difficult, the transfer residual toner is continuously scraped at a specific part of the contact charging means in a longitudinal direction. Thus, there is a problem in that the amount of interposal of the particles is relatively few with respect to the amount of contamination due to the toner in the part.

This problem occurs similarly in the case where the amount of transfer residual toner that is scraped by the contact charging means exceeds a predetermined amount, for example, in the case where the transfer efficiency is conspicuously poor under a certain condition, or in the case where a jam is occasioned at the time of image formation with a high printing ratio.

Namely, the alternating voltage is superimposed and applied to the contact charging means at the time of image formation, whereby the scraped transfer residual toner can be expelled to the downstream side in the rotational direction of the photosensitive drum. Thus, the toner is not accumulated on the contact charging means. However, the cleaning supporting particles interposed in the nip portion of the photosensitive drum and the contact charging means are also expelled, and the charging uniformity can not be secured if a plurality of bad conditions are present.

SUMMARY OF THE INVENTION

The present invention has been made in view of the above-described problem, and an object of the present invention is therefore to provide an image forming apparatus in which the effect of enlarging the apparatus and the increase in cost are suppressed.

Another object of the present invention is to provide an image forming apparatus in which conductive particles are prevented from separating from a charging member to an image bearing member.

Still another object of the present invention is to provide an image forming apparatus in which charging unevenness is prevented and a developer stuck to a charging member is easily expelled to an image bearing member.

Yet still another object of the present invention is to provide an image forming apparatus in which charging can be conducted stably to obtain satisfactory images without occurrence of charging defect over a long period of time.

DESCRIPTION OF THE PREFERRED EMBODIMENTS

Embodiment 1

A. Example of Image Forming Apparatus

Figure 1:
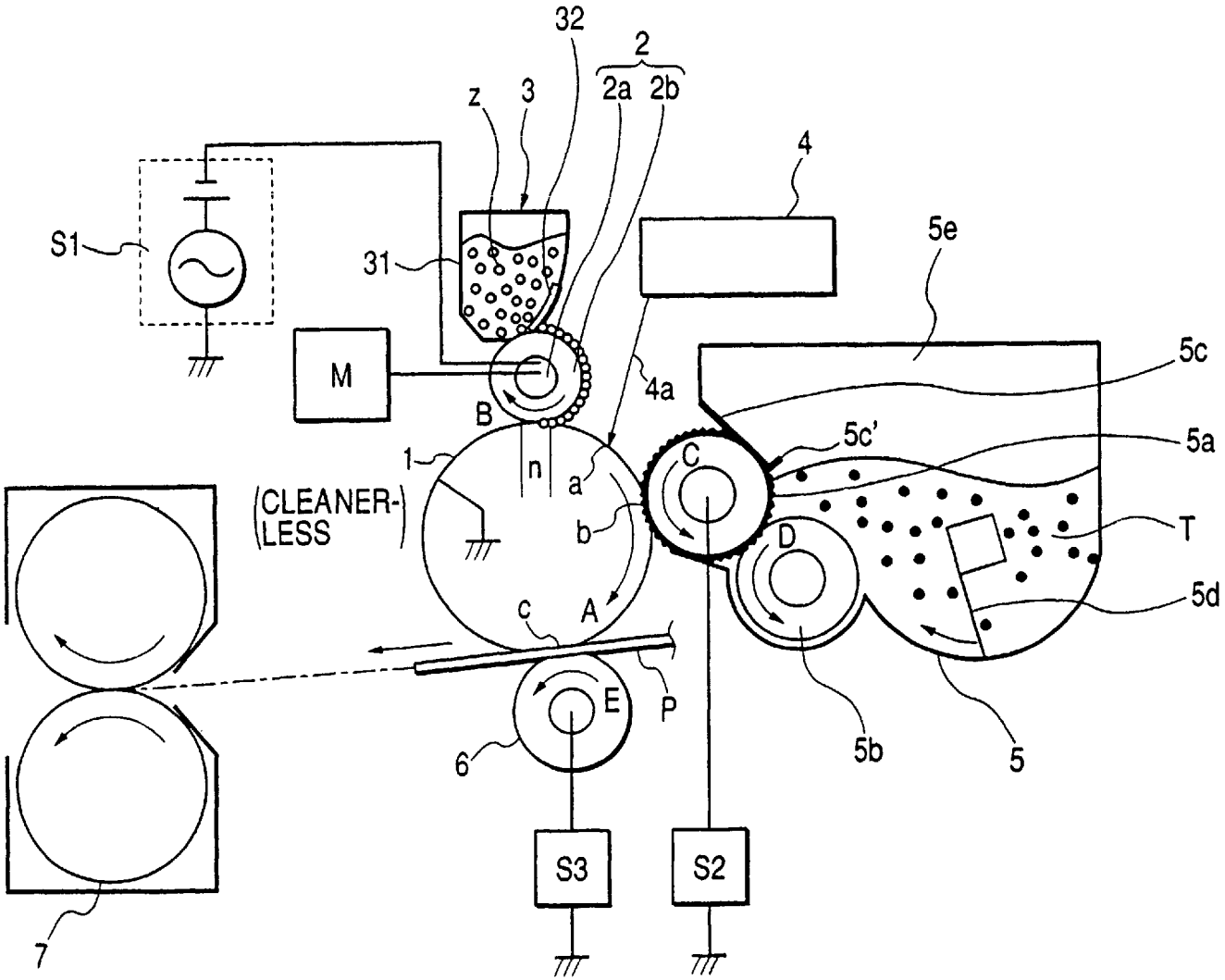
FIG. 1 is a structural diagram showing an outline of an image forming apparatus in accordance with a first embodiment (Embodiment 1) of the present invention.

FIG. 1 is a structural diagram of an outline of an example of an image forming apparatus according to the present invention. The image forming apparatus of this example is a laser printer (image recording apparatus) of a transfer electrophotographic process, of a contact charging system, of a reversal developing system, and of a cleanerless apparatus.

In the printer in accordance with this embodiment, a charging member of which at least a peripheral surface is porous and which has flexibility is made to be abutted with an image bearing member. At the time of image formation, a superimposed voltage by a direct current voltage and an alternating voltage of which a peak to peak voltage is less than a charging potential convergence voltage is applied to the charging member. Further, cleaning supporting particles (conductive particles) supplied from a cleaning supporting particles (conductive particles) supply means are interposed at least in a nip portion of the charging member and the image bearing member. Furthermore, the charging member scrapes a developer remaining on the image bearing member after transfer, also charges the surface of the image bearing member at a predetermined potential, and functions as a charging cleaning member for expelling the developer to the downstream side in a rotational direction of the image bearing member. The developer expelled from the charging member is subjected to cleaning simultaneous with developing by a developing means arranged so as to contact the image bearing member to thereby be reused.

On the other hand, at the time of non-image formation, only a direct current voltage is applied to the charging member. It is set such that a predetermined amount of the cleaning supporting particles supplied from the cleaning supporting particle supply means is interposed at least in the nip portion of the charging member and the image bearing member.

Reference numeral 1 denotes the image bearing member, which is a diameter of 30 mm (ϕ30 mm) OPC photosensitive body with negative polarity (drum-shape negative photosensitive body, hereinafter referred to as photosensitive drum) in this embodiment. This photosensitive drum 1 is rotatively driven with a constant moving speed of the peripheral surface of 50 mm/sec (=process speed) in a clockwise direction of an arrow A.

1. Charging Process

Reference numeral 2 denotes an elastic roller (hereinafter referred to as charging cleaning roller) as the charging member arranged so as to contact the photosensitive drum 1 with a predetermined pressing force, and the elastic roller is constituted of a core metal 2*a* and an elastic layer 2*b*. The elastic layer 2*b* has flexibility, and is a member of which at least the peripheral surface is porous. Reference symbol n denotes a charging nip portion that is a pressure contact portion of the photosensitive drum 1 and the charging cleaning roller 2. In order to conduct direct charging with efficiency, it is necessary to secure a large contact area between the photosensitive drum 1 and the charging cleaning roller 2 in the charging nip portion n. In this embodiment, the peripheral surface of the charging cleaning roller 2 is porous, whereby the maximum contact area is obtained.

The above-mentioned charging cleaning roller 2 holds (carries) cleaning supporting particles z having conductivity on their peripheral surface, and the cleaning supporting particles z, which are conductive particles with the purpose of accelerating charging and which are supplied from the cleaning supporting particle supply means 3, are interposed in the charging nip portion n that is the pressure contact portion of the photosensitive drum 1 and the charging cleaning roller 2.

The charging cleaning roller 2 is rotatively driven in an opposite direction (counter) to a rotational direction of the photosensitive drum 1 as indicated by an arrow B in the charging nip portion n, and contacts the peripheral surface of the photosensitive drum 1 with speed difference. Reference symbol M denotes a driving source of the charging cleaning roller 2. Further, a predetermined charging bias is applied to the charging cleaning roller 2 from a charging bias application power source S1 at the time of image recording of the printer. Thus, a contact charging process is conducted to the peripheral surface of the rotational photosensitive drum 1 with predetermined polarity and potential by a direct charging (injection charging) system.

In this embodiment, a moving speed of the peripheral surface of the charging cleaning roller 2 is set to 75 mm/sec. Here, the moving speed of the peripheral surface of the charging cleaning roller 2 is defined as the speed at which a predetermined point having an average outer diameter in the state that nothing abuts the peripheral surface moves by the rotation of the charging cleaning roller 2. Further, assuming that the peripheral velocity difference of the charging cleaning roller 2 and the photosensitive drum 1 is the rotational speed ratio of both the members, the peripheral velocity difference is 150% in the counter direction in this embodiment.

In this embodiment, a superimposed voltage:

DC voltage: −700 V

AC voltage: peak to peak voltage of 1.0 kV
frequency of 1.8 kHz
sine wave is applied to the core metal 2*a* of the charging cleaning roller 2 by the charging bias application power source S1. Thus, the peripheral surface of the photosensitive drum 1 is directly charged at a voltage substantially equal to the applied DC voltage (about −700 V).

The size of the superimposed alternating voltage greatly affects an expelling property of toner sticking to the charging cleaning roller 2 which has not transferred but remained on the photosensitive drum 1 (transfer residual toner). The details of the foregoing aspects will be described later.

On the other hand, the supply of the cleaning supporting particles z to the charging cleaning roller 2 is performed by the cleaning supporting particle supply means 3 in this embodiment. The cleaning supporting particle supply means 3 is constituted of a container 31 in which the cleaning supporting particles z are kept and a regulating blade 32, and takes the structure such that the regulating blade 32 is made to abut the peripheral surface of the charging cleaning roller 2, that the cleaning supporting particles z are stored and held between the charging cleaning roller 2 and the regulating blade 32, and that the cleaning supporting particles z are applied to the peripheral surface of the charging cleaning roller 2 by the regulating blade 32 to thereby be supplied to the charging cleaning roller 2. In this embodiment, the charging polarity of the particles z is positive charging polarity. The polarity is opposite to that of the DC voltage applied to the roller 2, and is opposite to a normal charging polarity of toner.

Further, in this embodiment, zinc oxide with resistivity of approximately $10^6$ Ω·cm and with an average particle size of about 1 μm is used for the cleaning supporting particles z.

2. Exposure Process

Reference numeral 4 denotes a laser beam scanner (exposing apparatus) including a laser diode, a polygon mirror and the like, as an information writing means.

This laser beam scanner 4 outputs a laser beam that is intensity-modulated in correspondence with a time-series electric digital pixel signal of target image information, and scanning exposure 4*a* is performed to a uniform charging surface of the rotational photosensitive drum 1 (peripheral surface of the photosensitive drum 1) at an exposed part a with the laser beam. This scanning exposure 4*a* enables formation of an electrostatic latent image corresponding to the target image information on the surface of the rotational photosensitive drum 1.

3. Developing Process

Reference numeral 5 denotes a developing device, which is a reversal developing device using non-magnetic one-component toner (nega toner) T as the developer. The developing device 5 in this embodiment is a contact developing means in which a developer carrying member contacts the photosensitive drum 1, and is composed of: a toner storing container 5*e* for storing the toner T; a developing roller 5*a* as the developer carrying member for developing an electrostatic latent image at a developing part b while contacting the photosensitive drum 1 and rotating in a counterclockwise direction of an arrow C; a supplying roller 5*b* as a toner supply means for supplying the toner T to the developing roller 5*a* by rotating in a counterclockwise direction of an arrow D; a developing blade 5*c* as a toner regulating means for regulating an application amount and a charge amount of the toner T on the developing roller 5*a*; an agitating member 5*d* for agitating the toner in the toner storing container 5*e* and for supplying the toner T to the supplying roller 5*b*, and the like.

In this embodiment, since the structure is adopted in which developing is performed with contact to the photosensitive drum 1 as a rigid body, it is desirable that the developing roller 5*a* has elasticity. Silicone rubber is used for the elastic layer. In addition, rubber generally used such as NBR rubber (NBR: nitrile rubber), butyl rubber, natural rubber, acrylic rubber, hydrin rubber or polyurethane rubber can be used as the rubber used for the elastic layer. Generally, an oil saturation amount of the rubber material is increased to attain low hardness.

When the developing roller 5*a* has a single layer, polyurethane rubber, silicone rubber, NBR rubber or the like is preferably used in the case where negatively charged toner is used from the viewpoint of charge imparting property to the toner. Further, in case of using positively charged toner, fluorine rubber or the like is preferably used.

Moreover, in the case where a coat layer is provided in the outer circumference of the elastic layer in consideration of charging to the toner, polyamide resin, polyurethane resin, silicone resin, acrylic resin, fluorine resin, and resin in which the above resins are mixed, or the like is preferably used.

Furthermore, as the developing blade 5*c*, it is possible to use a known toner regulating member in which an abutting portion with the developing roller 5*a* is comprised of a member made of metal, rubber or resin. In this embodiment, the developing blade 5*c* is used in which: a stainless thin plate (about 0.1 mm) is bent at the position at a distance of about 2 mm from the tip end portion in a direction opposite to the developing roller 5*a*; and a bent portion 5*c*' contacts the developing roller 5*a* while somewhat biting the developing roller 5*a*.

The toner T agitated by the agitating member 5*d* is supplied onto the developing roller 5*a* by abrasion sliding of an abutting portion of the developing roller 5*a* rotating in the C direction and the supplying roller 5*b* rotating in the D direction. The toner T on the developing roller 5*a* is imparted with a desired charge amount by the developing blade 5*c*, the toner amount is regulated, and the toner is appropriately carried on the developing roller 5*a*.

A predetermined developing bias is applied to the developing roller 5*a* from a developing bias application power source S2. The toner carried on the developing roller 5*a* selectively sticks to the surface of the photosensitive drum 1 in correspondence with an electrostatic latent image pattern formed on the peripheral surface of the photosensitive drum at the part that contacts the photosensitive drum 1, that is, the developing part b, whereby the electrostatic latent image is subjected to reversal developing to be visualized as a toner image. That is, the electrostatic latent image is developed with the toner having the same polarity as the charging polarity of the photosensitive body.

The developing bias voltage in this embodiment is set to a DC voltage: −400 V.

The developing means is not limited to the above-mentioned contact developing system. A known non-contact developing system (jumping developing or the like) may also be used.

4. Transfer Process

Reference numeral 6 denotes an elastic transfer roller in which a middle-resistance foaming layer is formed in a core metal. The roller is made to contact the photosensitive drum 1 with a predetermined pressing force to form a transfer nip portion c, and is rotatively driven in the E direction in the drawing.

A transferring material P as a recording medium is fed to the transfer nip portion c from a sheet feeding portion (not shown) at a predetermined timing. Also, a predetermined transfer bias voltage is applied to the transfer roller 6 from a transfer bias application power source S3. Thus, the toner image on the peripheral surface of the photosensitive drum 1 is sequentially transferred to the surface of the transferring material P fed to the transfer nip portion c.

The transfer roller 6 used in this embodiment is the roller in which the middle-resistance foaming layer is formed in the core metal and which has a roller resistance value of $5\times10^8$ Ω, and transfer is conducted by applying a voltage of +2.0 kV to the core metal.

At this time, in the transfer nip portion c, the toner image on the peripheral surface of the photosensitive drum 1 is positively transferred while being pulled to the transferring material P side with the influence of the transfer bias. On the other hand, since the cleaning supporting particles z on the peripheral surface of the photosensitive drum 1 have conductivity, they are not positively transferred to the transferring material P side, and are substantially stuck and held to be remained on the peripheral surface of the photosensitive drum 1. In order to prevent the particles z from being transferred to the transferring material P, the charging polarity of the particles z is desirably same as the charging polarity of the transfer bias, that is, opposite to the normal charging polarity of the toner. Note that, due to the presence of the cleaning supporting particles z stuck to and held on the peripheral surface of the photosensitive drum 1, there is obtained the effect of improving the transfer efficiency of the toner image from the photosensitive drum 1 to the transferring material P.

5. Fixing Process

Reference numeral 7 denotes a fixing apparatus of a heat fixing system or the like. The transferring material P, to which the toner image on the peripheral surface of the photosensitive drum 1 is transferred at the transfer nip portion c, is conveyed and introduced to the fixing apparatus 7, and undergoes fixation of the toner image, to thereby be expelled to the outside of the apparatus as an image formed material (print, copy).

6. Cleanerless

The transfer residual toner remaining on the peripheral surface of the photosensitive drum 1 after transfer and the cleaning supporting particles z are carried to the charging nip portion n of the photosensitive drum 1 and the charging cleaning roller 2 by the rotation of the photosensitive drum 1. Thus, the supply of the cleaning supporting particles z to the charging nip portion n and sticking and mixing of the cleaning supporting particles z to the charging cleaning roller 2 are occurred. Namely, contact charging of the photosensitive drum 1 is conducted in the state that the cleaning supporting particles z exist in the charging nip portion n formed by the photosensitive drum 1 and the charging cleaning roller 2.

The cleanerless structure is adopted in the image forming apparatus in this embodiment, and thus, a dedicated cleaner (cleaning apparatus) such as a cleaning blade is not arranged. Therefore, the transfer residual toner remaining on the peripheral surface of the photosensitive drum 1 after transfer of the toner image to the transferring material P reaches the developing part b through the charging nip portion n with the rotation of the photosensitive drum 1, and is collected and reused by conducting cleaning simultaneous with developing in the developing device 5.

Figure 2:
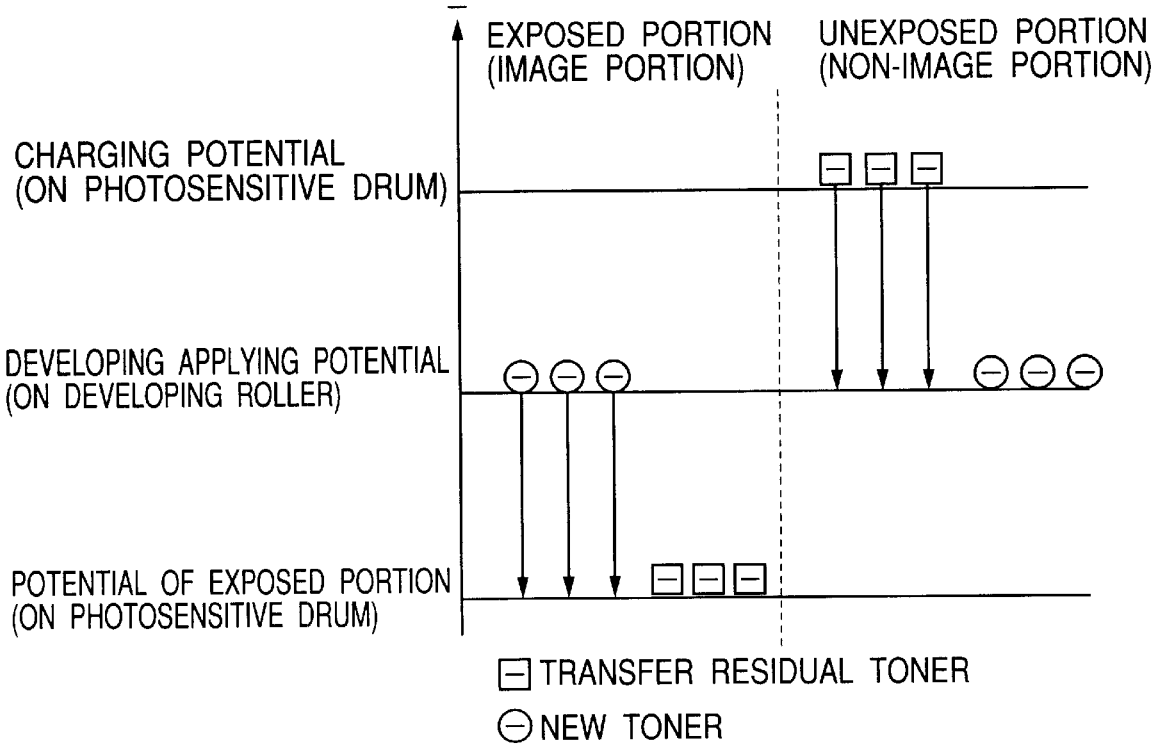
FIG. 2 is an explanatory diagram of a cleaning simultaneous with developing system.

An explanation will be made on the cleaning simultaneous with developing with reference to FIG. 2 below. In the drawing, reference symbol □ denotes the transfer residual toner existing on the surface of the photosensitive drum 1, and reference symbol ○ denotes new toner which has passed the developing blade 5*c* and is carried on the developing roller 5*a*. Reference symbol—in the above symbols indicates the charging polarity of the toner.

The transfer residual toner (toner which has not been transferred to the transferring material P in the transfer process and remains on the surface of the photosensitive drum 1) receives the abrasion sliding of the photosensitive drum 1 and the charging cleaning roller 2 and the action of the cleaning supporting particles z described later at the contact portion n (charging nip portion) of the photosensitive drum 1 and the charging cleaning roller 2, thereby becoming the negatively charged toner. Sequentially, an exposed portion (image portion) of the surface of the photosensitive drum 1 is at about −150 V by the exposure process. Further, in the developing process, the transfer residual toner on the exposed portion remains on the photosensitive drum 1 as it is, and the new toner carried on the developing roller 5*a* is supplied (developed) to the exposed portion due to the potential difference (about 250 V) between the developing bias (−400 V) and the potential of the exposed portion. At the same time, the negatively charged transfer residual toner of a non-exposed portion (non-image portion) is transferred onto the developing roller 5*a* due to the potential difference between the charging potential (about −700 V) on the photosensitive drum 1 and the developing bias (−400 V). At this time, the new toner carried on the developing roller 5*a* remains on the developing roller 5*a* at it is, and thus, cleaning simultaneous with developing is conducted.

(B) Operation Process of Image Forming Apparatus

Figure 3:
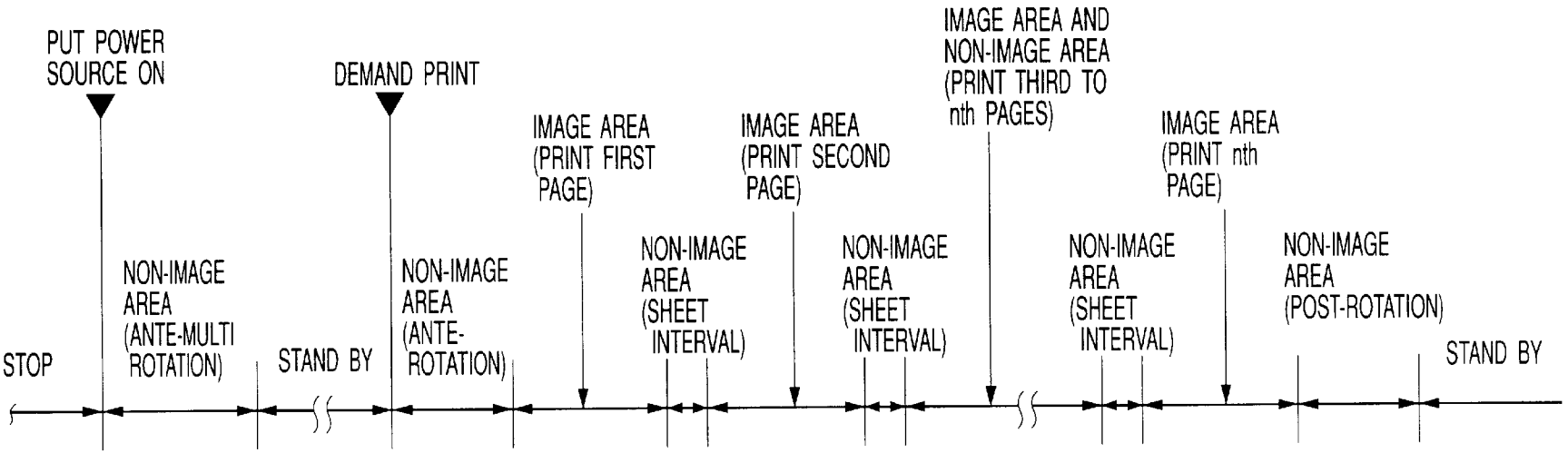
FIG. 3 is an operation process diagram of the image forming apparatus.

FIG. 3 is an operation process diagram of the image forming apparatus in this embodiment.

a. Ante-Multiple Rotation Process

This process corresponds to a starting operational period (warming period) of the image forming apparatus. A main power source switch is turned on. Thus, a main motor (not shown) of the apparatus is driven to rotatively drive the photosensitive drum 1, and predetermined preparation operation such as preparation processing such as setting of a fixing device and density control for the image forming operation is performed.

After the predetermined apparatus starting operational period is ended, the drive of the main motor is stopped, and the apparatus is kept in a standby (waiting) state till a print request (request for a start of the image forming operation) signal is input.

b. Ante-Rotation Process

When the print request signal is input in the standby state, the period comes in which the main motor is driven again to rotatively re-drive the photosensitive drum 1, and preparation processing operation, which is conducted before image formation, such as setting the fixing device, a scanner and the like if necessary and stabilization of the photosensitive drum potential is performed.

c. Printing Process (Image Forming Process)

The predetermined ante-rotation process is ended, and then, a predetermined sequence of image forming processes such as charging, image exposure and developing with respect to the rotational photosensitive drum 1 and toner image transfer to a transferring material is performed. The transferring material P having been subjected to the toner image transfer is conveyed to the fixing apparatus 7, and then, a printing process for a first sheet is conducted.

In case of a continuous printing mode, the printing process is repeated, thereby sequentially conducting the printing processes for n sheets corresponding to a predetermined set number.

d. Sheet Interval Process

This process corresponds to a non-image forming area of a non-sheet passing state period (between transferring materials) of the transferring material P in a transferring part c from when the rear end of the transferring material P has passed the transferring part c until the leading end of the next transferring material P reaches the transferring part c in the continuous printing mode.

e. Post-Rotation Process

This process corresponds to the period in which, after the last printing process for the n-th sheet is ended, the photosensitive drum 1 is rotatively driven by continuously driving the main motor until the apparatus returns to the standby state, whereby predetermined post-processing operation of the apparatus such as collection of the transfer residual toner to the developing device is performed.

When the predetermined post-rotation process is ended, the drive of the main motor is stopped, and the rotational drive of the photosensitive drum 1 is stopped. The apparatus is kept in the standby state again until the next print request signal is input.

In the above situation, in the case where the print request signal is input immediately after the ante-multiple rotation process, the printing process is sequentially performed through the ante-rotation process. In case of printing of only one sheet, after the printing process is ended, the apparatus reaches the stand-by state through the post-rotation process.

In the above situation, a. ante-multiple rotation process, b. ante-rotation process, and e. post-rotation process correspond to non-image formation, and the non-image area on the drum surface in d. sheet interval process also corresponds to non-image formation. The image area on the photosensitive drum surface in c. printing process corresponds to image formation.

(C) Charging Cleaning Roller 2

The charging cleaning roller 2 as the contact charging member in this embodiment is formed by, on the core metal 2*a*, forming the roller-shape semiconductor layer 2*b* made of foam prescribed by resin (e.g. urethane), conductive particles (e.g. carbon black), a sulfurizing agent, a foaming agent or the like.

Further, besides the above-mentioned resin (urethane or the like), the foamed rubber material in which EPDM rubber (ethylene propylene diene rubber), NBR rubber (nitrile rubber), silicone rubber, IR rubber (isoprene rubber) or the like is dispersed with carbon black for resistance adjustment or conductive substance such as metal oxide, or the porous rubber material by having been subjected to foaming processing only on the peripheral surface can be used for the charging cleaning roller 2. In particular, the resistance adjustment can be conducted by using an ion conductive material without dispersing the conductive substance.

The charging cleaning roller 2 is made such that at least the peripheral surface is made finely porous. Thus, the number of opportunities of contact to the peripheral surface of the photosensitive drum 1 is increased. Also, when the transfer residual toner is flown into the charging nip portion n, a hole plays a role for catching and scraping toner from the peripheral surface of the photosensitive drum 1. Thus, contact between the members can be retained.

The rotational direction of the charging cleaning roller 2 to the rotational direction of the photosensitive drum 1 is set as the counter direction. Thus, the transfer residual toner is once scraped from the peripheral surface of the photosensitive drum 1, and direct charging can be conducted with efficiency in the state that the transfer residual toner hardly exists in the charging nip portion n formed by the charging cleaning roller 2 and the photosensitive drum 1. The transfer residual toner which has reached to the charging nip portion n from the transfer nip portion c is scraped. Therefore, particularly in a halftone image, the image pattern portion in the previous time which appears as a ghost image is eliminated.

The surface of the roller of the semiconductor layer 2*b* formed as described above is polished if necessary, whereby the charging cleaning roller 2 that is a conductive elastic roller is formed with a diameter of 12 mm and a longitudinal length of 230 mm.

On the other hand, the roller resistance of the charging cleaning roller 2 of this embodiment was measured, and the value was 100 kΩ. The roller resistance is measured by applying 100 V between the core metal 2*a* and the aluminum drum in the state that the ϕ30 mm aluminum drum is in pressed-contact with the charging cleaning roller 2 in order that a total pressure of 9.8 N (1 kg) is applied to the core metal 2*a* of the charging cleaning roller 2.

It is important that the charging cleaning roller 2 functions as an electrode. That is, it is required that the roller is made to have elasticity to obtain a sufficient contact state with a member to be charged and simultaneously has sufficient low resistance for charging the moving member to be charged. On the other hand, it is necessary to prevent leakage of a voltage in the case where a low pressure-leakage resistance defect part such as a pin hole exists in the member to be charged. In case of using an electrophotographic photosensitive body as the member to be charged, it is desirable that the charging cleaning roller 2 has a resistance of $10^4$ to $10^7$ Ω in order to obtain sufficient charging property and leakage-resistance.

Further, as to the hardness of the charging cleaning roller 2, since the shape is not stabilized when the hardness is too low, the contacting property with the member to be charged (photosensitive drum) declines. On the contrary, when the hardness is too high, not only the charging nip portion n cannot be secured with the member to be charged, but also, the micro contacting property to the surface of the member to be charged declines. Thus, it is preferable that the hardness is in a range of 25 to 50 degrees in asker C hardness.

(D) Toner T

A description is now made in detail regarding the toner T that is the developer used in this embodiment. The toner mentioned here is constituted of toner particles and an external additive.

In the image forming apparatus of this embodiment, the toner that can be obtained by a grinding method, a polymerization method or the like, which has been known conventionally, can be used. However, in particular, the toner particles described below are preferably used.

The toner particles according to the present invention preferably have a value of a shape factor SF-1 of 100 to 150 and a value of a shape factor SF-2 of 100 to 140, more preferably, have a value of the shape factor SF-1 of 100 to 140 and a value of the shape factor SF-2 of 100 to 120, which are measured by an image analyzing apparatus. Further, the above conditions are satisfied, and also, the value of (SF-2)/(SF-1) is set at 1.0 or less. Thus, not only the several properties of the toner particles but also matching with the image forming apparatus becomes extremely satisfactory.

As to SF-1 and SF-2 indicating the shape factors used in the present invention, the 100 images of the toner particles, which are magnified 500 times by using FE-SEM (S-800) produced by Hitachi, Ltd., are sampled at random, the image information is introduced into an image analyzing apparatus (Luzex3) produced by Nicolet Japan Corp. through an interface to perform an analysis. Then, the values obtained by calculation with the following expressions are defined as the shape factors SF-1 (FIG. 4) and SF-2 (FIG. 5) in the present invention.

$$\text{SF-1}=\{(MXLNG)^2/\text{AREA}\}\times(\pi/4)\times 100$$

$$\text{SF-2}=\{(PERI)^2/\text{AREA}\}\times(1/4\pi)\times 100$$

AREA: toner particle projection area

MXLNG: absolute maximum length

PERI: peripheral length

The shape factor SF-1 of the toner particles indicates the degree of sphericity of the toner particle, which gradually changes from a spherical shape to an unstable shape. SF-2 indicates the degree of unevenness of the toner particle, and the unevenness of the surface of the toner particle becomes conspicuous.

When the shape factor SF-1 exceeds 160, the shape of the toner particle becomes unstable. Thus, the distribution of the charge amount of the toner particles becomes broad, and also, the surfaces of the toner particles are easy to be polished and crushed in the developing device. Thus, this becomes a factor in reduction of image density or image fog.

In order to raise the transfer efficiency of the toner particle images, it is favorable that the shape factor SF-2 of the toner particles is 100 to 140, and that the value of (SF-2)/(SF-1) is 1.0 or less. In the case where the shape factor SF-2 of the toner particles is larger than 140 and the value of (SF-2)/(SF-1) exceeds 1.0, the surfaces of the toner particles are not smooth, and the toner particles have a large amount of unevenness. There is a tendency that the transfer efficiency from the photosensitive drum 1 to the transferring material P or the like is lowered.

Furthermore, it is preferable that the toner particles of which the surfaces are covered with the external additive (including the cleaning supporting particles described later) are used as the toner particles used in the present invention and that the toner particles are imparted with a desired charge amount.

In the above meaning, the covering ratio of the external additive of the surface of the toner particle is preferably 5 to 99%, more preferably, 10 to 99%.

As to the covering ratio of the external additive of the surface of the toner particle, the 100 images of the toner particles are sampled at random by using FE-SEM (S-800) produced by Hitachi, Ltd., and the image information is introduced into the image analyzing apparatus (Luzex3) produced by Nicolet Japan Corp. through an interface. The obtained image information differs in brightness between the part of the toner particle surface and the part of the external additive, and thus are two-valued. Then, the area of the external additive part SG and the area of the toner particle part (including the area of the external additive part) ST are obtained. Thus, the covering ratio is calculated by the following expression.

$$\text{covering ratio of external additive } (\%) = (SG/ST) \times 100$$

Silica that is known and used, or the like can be given as the external additive.

The external additive of 0.01 to 10 parts by weight, preferably of 0.05 to 5 parts by weight, is used to the toner particles of 100 parts by weight. Further, either a single external additive or a plurality of external additives may be used. The respective external additives that have been subjected to hydrophobic processing are preferable.

In the case where the addition amount of the external additive is less than 0.01 part by weight, the flowability of a one-component developer is deteriorated, and the efficiency of transfer and developing is lowered. Thus, there is occurred so-called dispersing, which indicates density unevenness of an image or dispersing of the toner to the periphery of an image portion. On the other hand, in the case where the amount of the external additive exceeds 10 parts by weight, the excessive external additive sticks to the photosensitive drum 1 or the developing roller 5*a*, which deteriorates the charging property to the toner or disturbs the image.

(E) Cleaning Supporting Particles z

As to the material of the cleaning supporting particles z used in this embodiment, it is possible to use various conductive particles such as conductive inorganic particles of metal oxide (for example, aluminum oxide, titanium oxide, tin oxide, zinc oxide, or the like), the mixture of the conductive inorganic particles and an organic material, or the conductive particles or the mixture, which has been subjected to surface processing.

The particle resistance is calculated as resistivity as shown below. In the calculation of the resistivity, a powder sample of approximately 0.5 g is put in a circular cylinder with an area of the base of 2.26 $cm^2$, 147 N (15 kg) is applied to upper and lower electrodes, at the same time, a voltage of 100 V is applied to measure the resistance value, and then, the value is normalized.

The resistivity of the cleaning supporting particles z calculated by the above method is necessarily $10^{12}$ Ω·cm or less, desirably $10^{10}$ Ω·cm or less, in order to perform the transfer of charge through the cleaning supporting particles z.

The particle size of the cleaning supporting particles z was determined as follows. One hundred or more cleaning supporting particles z are sampled in observation with an optical or electron microscope, volume particle size distribution is calculated with the maximum chord length in a horizontal direction, and the average particle size of 50% is obtained.

It is desirable that the particle size of the cleaning supporting particles z calculated by the above measurement is 0.1 to 3 μm in order that the cleaning supporting particles z function as a micro carrier or spacer carrier described later. In the case where the particle size is 0.1 μm or less, the cleaning supporting particles z easily stick to the toner having the particle size that is generally adopted, and follow the movement of the toner. Thus, the effect of the cleaning supporting particles z as the spacer carrier is lowered. On the other hand, in the case where the particle size exceeds 3 μm, the cleaning supporting particles z become difficult to be interposed in the toner and to sufficiently contact the toner. Thus, the toner becomes difficult to have negative polarity.

The cleaning supporting particles z exist not only in the state of primary particles but also in the state that secondary particles are aggregated, which causes no problem. The form of the cleaning supporting particles z is not important provided that the function of the cleaning supporting particles as an aggregate is realized even with any aggregated state.

On the other hand, taking into consideration the point that the cleaning supporting particles z are partially transferred to the transferring material P from the photosensitive drum 1, there is a fear that color reproducibility may be impaired unless white or almost transparent particles are used particularly in a full-color image forming apparatus. Further, in the case where the cleaning supporting particles z are used for charging of the photosensitive drum 1, it is important that they do not become a hindrance, or do not shield light, at the time of exposure of a latent image, and it is desirable that the white or almost transparent particles are used. Further, the cleaning supporting particles z are preferably non-magnetic.

(F) Direct Charging (Injection Charging), Expelling of Toner

In the present invention, injection charging of a direct charging system is used as a charging system. That is, the charging cleaning roller 2 with a porous surface is made to abrasively slide with the photosensitive drum 1 with peripheral velocity difference, whereby charging can be conducted at a predetermined potential. However, in a cleanerless system which specially does not include a cleaner container, the toner is not transferred to the transferring material P from the photosensitive drum 1 in the transfer process, and the toner remaining on the photosensitive drum 1 (transfer residual toner) directly reaches the charging cleaning roller 2.

When the transfer residual toner in the image forming apparatus of this embodiment reaches the upstream side in the rotational direction of the photosensitive drum 1 of the charging nip portion n formed by the charging cleaning roller 2 and the photosensitive drum 1 along with the rotation of the photosensitive drum 1, the transfer residual toner is scraped from the surface of the photosensitive drum 1 by the mechanically and abrasively sliding force generated between the wall of the hole of the charging cleaning roller 2 and the peripheral surface of the photosensitive drum 1, which are driven with the speed difference. The transfer residual toner scraped as mentioned above reaches the downstream side in the rotational direction of the photosensitive drum 1 of the charging nip portion n along with the rotation of the charging cleaning roller 2. Simultaneously, in the charging nip portion n, charge is injected to the peripheral surface of the photosensitive drum 1 from the surface of the charging cleaning roller 2, charging is conducted to the peripheral surface of the photosensitive drum 1, and the surface potential on the charged photosensitive drum 1 nearly reaches the value of the applied direct current voltage.

On the other hand, a direct current voltage and an alternating voltage are superimposedly applied to the charging cleaning roller 2. Thus, an alternating electric field is formed between the charging cleaning roller 2 and the photosensitive drum 1. Therefore, the transfer residual toner, which has reached the downstream side in the rotational direction of the photosensitive drum 1 of the charging nip portion n along with the rotation of the charging cleaning roller 2, repeats reciprocation between the peripheral surface of the photosensitive drum 1 and the peripheral surface of the charging cleaning roller 2 due to the potential difference that is continuously generated in the peripheral surface of the photosensitive drum 1 and the peripheral surface of the charging cleaning roller 2. At this time, the photosensitive drum 1 is rotating. The transfer residual toner stuck to and carried on the photosensitive drum 1 gets out of an action area of the above alternating electric field to thereby be expelled from the peripheral surface of the charging cleaning roller 2.

Here, the cleaning supporting particles z carried on the peripheral surface of the charging cleaning roller 2 act as the micro carrier or spacer carrier. Thus, the above expelling can be effectively performed.

That is, in the process that the transfer residual toner and the cleaning supporting particles z are mixed to be carried on the peripheral surface of the charging cleaning roller 2, the cleaning supporting particles z act as the micro carrier. In other words, the cleaning supporting particles z become to have positive polarity, thereby imparting negative charge to the transfer residual toner. Further, the cleaning supporting particles z function as the spacer carrier by being interposed between the charging cleaning roller 2 and the transfer residual toner. Due to the action of the alternating electric field on the downstream side in the rotational direction of the photosensitive drum 1 of the charging nip portion n, the toner can be further easily expelled from the charging cleaning roller 2. Moreover, the polarity of the expelled toner also becomes negative, and thus, toner collection by the developing roller 5*a* in the next process can be certainly conducted. At this time, the toner having an almost spherical shape with the above-mentioned shape factors is used, whereby the above expelling of toner and toner collection in the developing device can be effectively realized.

The alternating voltage applied to the charging cleaning roller 2 preferably has a large gradient of potential per unit time. This is because it is considered the larger the potential gradient becomes, the larger the potential difference between the peripheral surface of the charging cleaning roller 2 and the surface of the photosensitive drum 1 becomes. Further, the toner is expelled with efficiency, whereby the surface of the charging cleaning roller 2 always contacts the peripheral surface of the photosensitive drum 1 while being exposed. Thus, high charging property to the photosensitive drum 1 can be secured. Further, when the surface of the charging cleaning roller 2 is exposed, the wall of the hole can abrasively slide on the peripheral surface of the photosensitive drum 1 with firmness. Thus, collecting property of the next transfer residual toner is improved.

Figure 6:
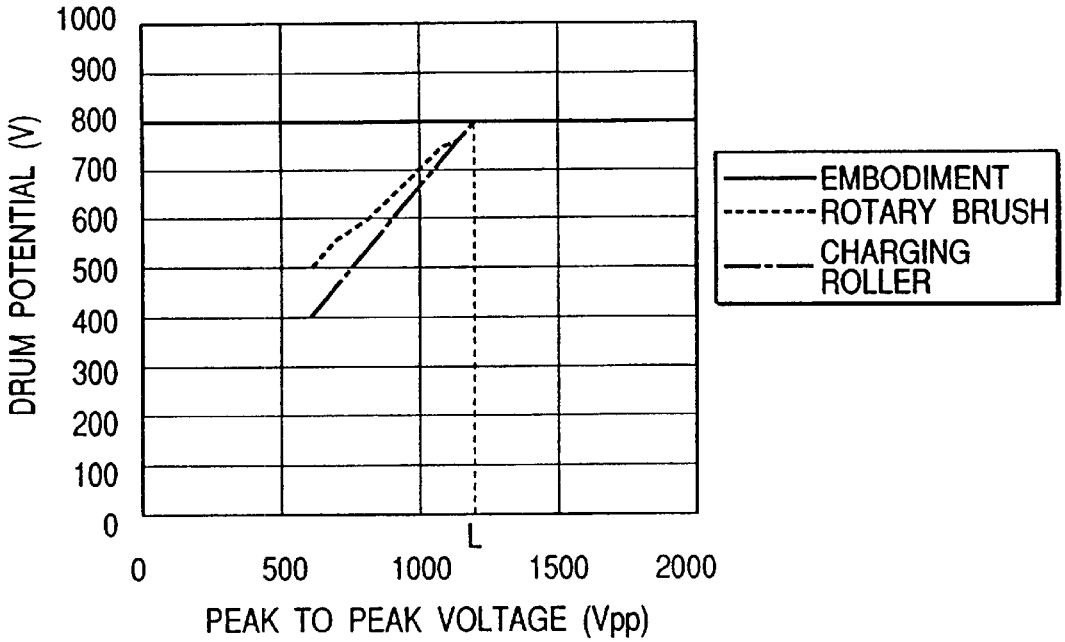
FIG. 6 is a diagram showing charging property in the case where only a direct current voltage is applied as a charging applying bias.

Furthermore, since the injection charging system is adopted in the present invention, charging is conducted using the peak to peak voltage equal to or lower than an L point in FIG. 6. Therefore, a discharge action is not mainly used for charging the surface of the photosensitive drum 1, as a result of which the toner does not become to have positive polarity.

Moreover, even in the case where positively charged toner and negatively charged toner are mixed in the transfer residual toner, in the charging nip portion n formed by the charging cleaning roller 2 and the photosensitive drum 1, the transfer residual toner is abrasively slid when being scraped from the peripheral surface of the photosensitive drum 1, or the transfer residual toner which has been scraped from the peripheral surface of the photosensitive drum 1 and stuck to and carried on the charging cleaning roller 2 to thereby invade the charging nip portion n again, is abrasively slid when reaching the charging nip portion n again. Thus, along with the action of the above-mentioned cleaning supporting particles as the micro carrier, the toner undergoes frictional charging to have negative polarity.

Further, as to the size of the alternating voltage applied by being superimposed on the direct current voltage, it is desirable that the voltage has a peak to peak voltage of 500 V or more and is less than a charging potential convergence voltage (the L point of FIG. 6, 1,200 Vpp in this embodiment). When the peak to peak voltage is 500 V or less, the potential difference (between the peripheral surfaces of the charging cleaning roller 2 and of the photosensitive drum 1) for expelling the toner due to the alternating voltage as described above cannot be obtained. Thus, it is difficult that the toner is scraped from the charging cleaning roller 2 to be made to reciprocate between the charging cleaning roller 2 and the photosensitive drum 1. On the other hand, when the peak to peak voltage is equal to or higher than the charging potential convergence voltage, the discharge action of the charging cleaning roller 2 is increased. In this case as well, there is not generated the potential difference for expelling the toner stuck to the charging cleaning roller 2. Therefore, the reciprocation between the charging cleaning roller 2 and the photosensitive drum 1 becomes difficult, and thus, the toner is accumulated on the charging cleaning roller 2. Furthermore, if the discharge action is increased, the toner comes to have positive polarity.

When the peak to peak voltage is set to the charging potential convergence voltage or higher, charging due to the discharge action is dominant. This means that the voltage exceeds the peak to peak voltage that is twice as large as the threshold of the voltage at the time of discharge start. That is, the voltage exceeds the peak to peak voltage that is twice as large as the threshold of the voltage at the time of discharge start, whereby AC discharge is stably maintained. This action is opposed to the action described in relation to the image forming apparatus in this embodiment.

Note that, the charging potential convergence voltage is the applied alternating voltage at the time when the charging potential of the image bearing member is converged. In order to measure the charging potential convergence voltage, it is desirable that the conductive particles are not interposed in the nip portion of the charging cleaning roller 2 and the photosensitive drum 1 and that the roller 2 is rotated so as to follow the drum (G) Difference with Conventional Charging System The difference with a conventional charging system different from the image forming apparatus in this embodiment is described here.

Figure 7:
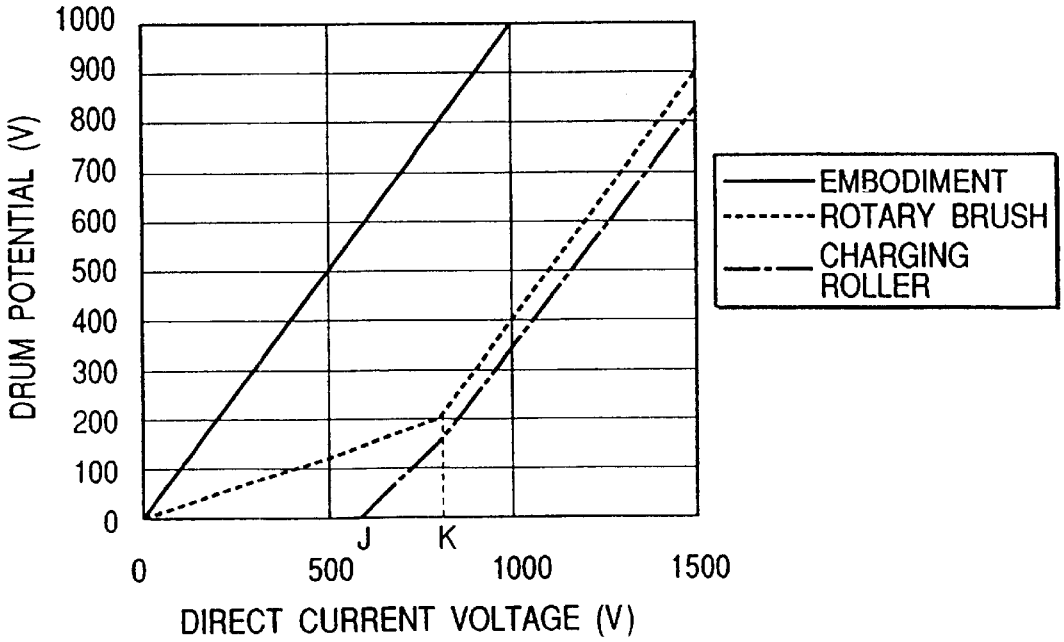
FIG. 7 is a diagram showing charging property in the case where a direct current voltage and an alternating voltage are superimposedly applied as the charging applying bias.

FIG. 6 is a diagram showing charging property in the case where a direct current voltage and an alternating voltage are superimposedly applied as a charging applying bias, which shows the case where the potential of the photosensitive drum is charged at about −800 V. FIG. 7 is a diagram showing charging property in the case where only a direct current voltage is applied as a charging applying bias.

Figure 4:
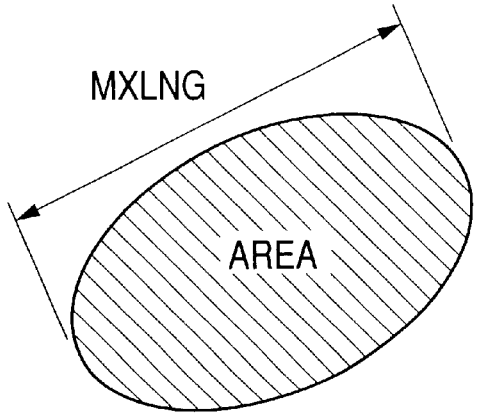
FIG. 4 is an explanatory diagram of a shape factor SF-1 of toner.
Figure 5:
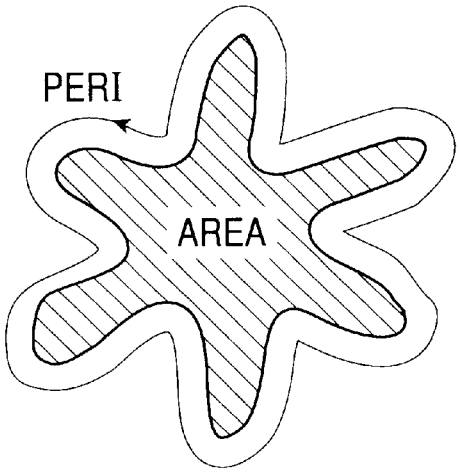
FIG. 5 is an explanatory diagram of a shape factor SF-2 of toner.

It is necessary that the alternating voltage having a peak to peak voltage equal to or higher than the charging potential convergence voltage corresponding to the L point in FIG. 4 (1,200 Vpp in the structure of this embodiment) is applied to the charging cleaning roller for conducting charging with the use of discharge action (hereinafter referred to as discharge roller). In the case where the alternating voltage having a peak to peak voltage of the L point or higher, continuous discharge is occurred in the discharge roller, and thus, it becomes difficult to generate the potential difference between the discharge roller and the photosensitive drum 1. Thus, the toner stuck onto the discharge roller cannot be expelled onto the photosensitive drum 1 with efficiency. Further, since positive ions generated due to discharge are pulled to the discharge roller side with a potential lower than that of the surface of the photosensitive drum 1, the toner stuck onto the discharge roller becomes to have the opposite polarity (negatively charged toner is charged with positive polarity).

From the above, the discharge roller has the accumulated transfer residual toner, cannot charge the photosensitive drum at a normal surface potential, and thus, invites charging defect. Further, even if the above-mentioned toner having had the opposite polarity is scraped from the discharge roller by a mechanically and abrasively sliding force, and then is expelled to the photosensitive drum 1, the toner cannot be collected in the developing device. Therefore, the toner causes image fog, which leads to defects in output images. Moreover, in order that the discharge roller secures stable charging property, the surface of the charging cleaning roller is made smooth as much as possible. Therefore, the ability to scrape the transfer residual toner is poor, and while the transfer residual toner remains on the photosensitive drum, a series of processes such as charging, exposure and developing in accordance with the next image formation is conducted. As a result, not only the charging uniformity is impaired, but also, a faithful latent image is not formed with respect to a predetermined image. There may be a case where image defect is occurred such that a residual image at the previous image formation appears while overlapping the image to be sequentially formed as a so-called memory image (ghost image).

The above tendency is also seen in the charging using a rotating brush as a contact charging member. Particularly in the case where the AC charging system is used in the rotating brush, the transfer residual toner is taken into the brush. Thus, there is occurred defect that the brush is solidified due to the use for a long period of time.

Further, in the DC charging system, in which only a direct current voltage is applied, among charging systems using discharge, application of a voltage corresponding to J and K points of FIG. 7 or higher voltage is required. In the DC charging system, the discharge action is weak (charge imparting property is low) in comparison with the AC charging system. Thus, the action for extremely imparting positive polarity to the toner stuck to the discharge roller is poor, and the amount of action is decreased. However, as in the AC charging system, the toner having had the positive polarity is accumulated on the discharge roller. When the toner is accumulated on the discharge roller as described above, uniform discharge becomes difficult to occur in a discharge area. As a result, the photosensitive drum 1 cannot be charged at a predetermined potential. Further, in the charging using the rotating brush, the transfer residual toner is taken into the brush, and the solidification of the brush is easy to occur as in the AC charging system.

On the other hand, in the case where only the direct current voltage is applied to the charging cleaning roller 2 in the image forming apparatus in this embodiment, the potential difference is hardly caused on the downstream side in the rotational direction of the photosensitive drum 1 of the charging nip portion n formed by the charging cleaning roller 2 and the photosensitive drum 1. Thus, the action of expelling the toner stuck to the peripheral surface of the charging cleaning roller 2 is difficult to occur. Therefore, in this case as well, contamination of the charging cleaning roller 2 is generated, whereby injection charging property is lowered, which leads to charging defect.

Here, in order to describe the present invention in detail, an explanation is now made with comparative examples as to charging performance under the condition in which charging uniformity is difficult to be secured.

Using the image forming apparatus in this embodiment, an endurance test was conducted in which 1000 sheets of images are continuously output with a constant image pattern. The occurrence level of a ghost image is evaluated. Then, difference of charging property was compared.

Figure 8:
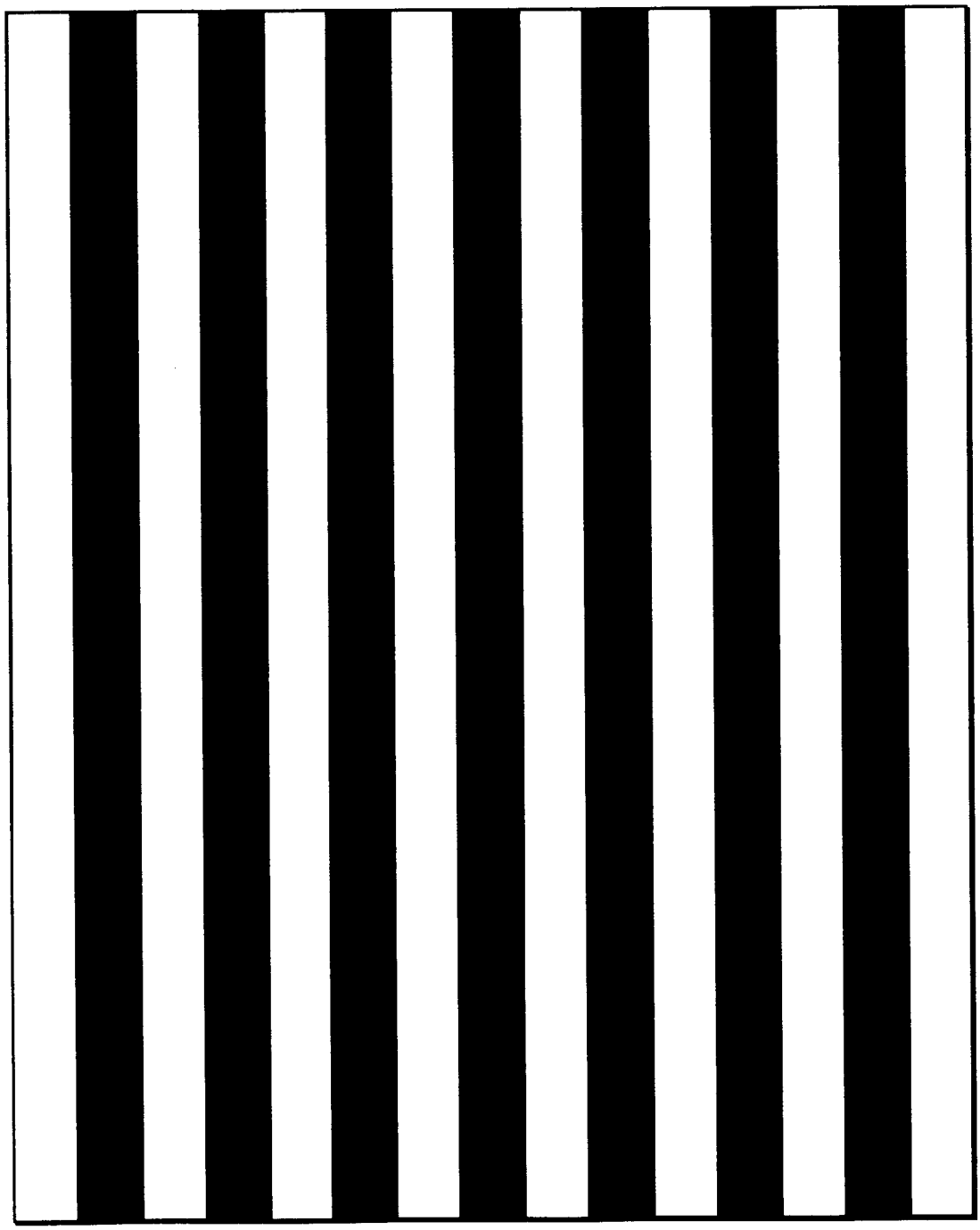
FIG. 8 is a diagram showing an image sample used in evaluation in accordance with the first and second embodiments (Embodiments 1 and 2) of the present invention.

In low temperature and low humidity environment (15° C./10%) in which securing of the charging property is difficult as the environment for conducting endurance evaluation, the image pattern shown in FIG. 8, in which longitudinal belts and blanks are combined, is adopted.

The reversal developing system is adopted in the image forming apparatus in this embodiment. Thus, the above-mentioned ghost image indicates the image in which the portion that has undergone image exposure (toner image portion) in the first circuit of the photosensitive drum 1 causes charging defect in the second circuit of the photosensitive drum 1, whereby the previous image pattern portion is developed with a larger amount of toner compared with other parts (image density is high).

Further, a halftone image (whole image) is output with a predetermined timing, and this is used in judgment of the occurrence level of the above ghost image.

Figure 9:
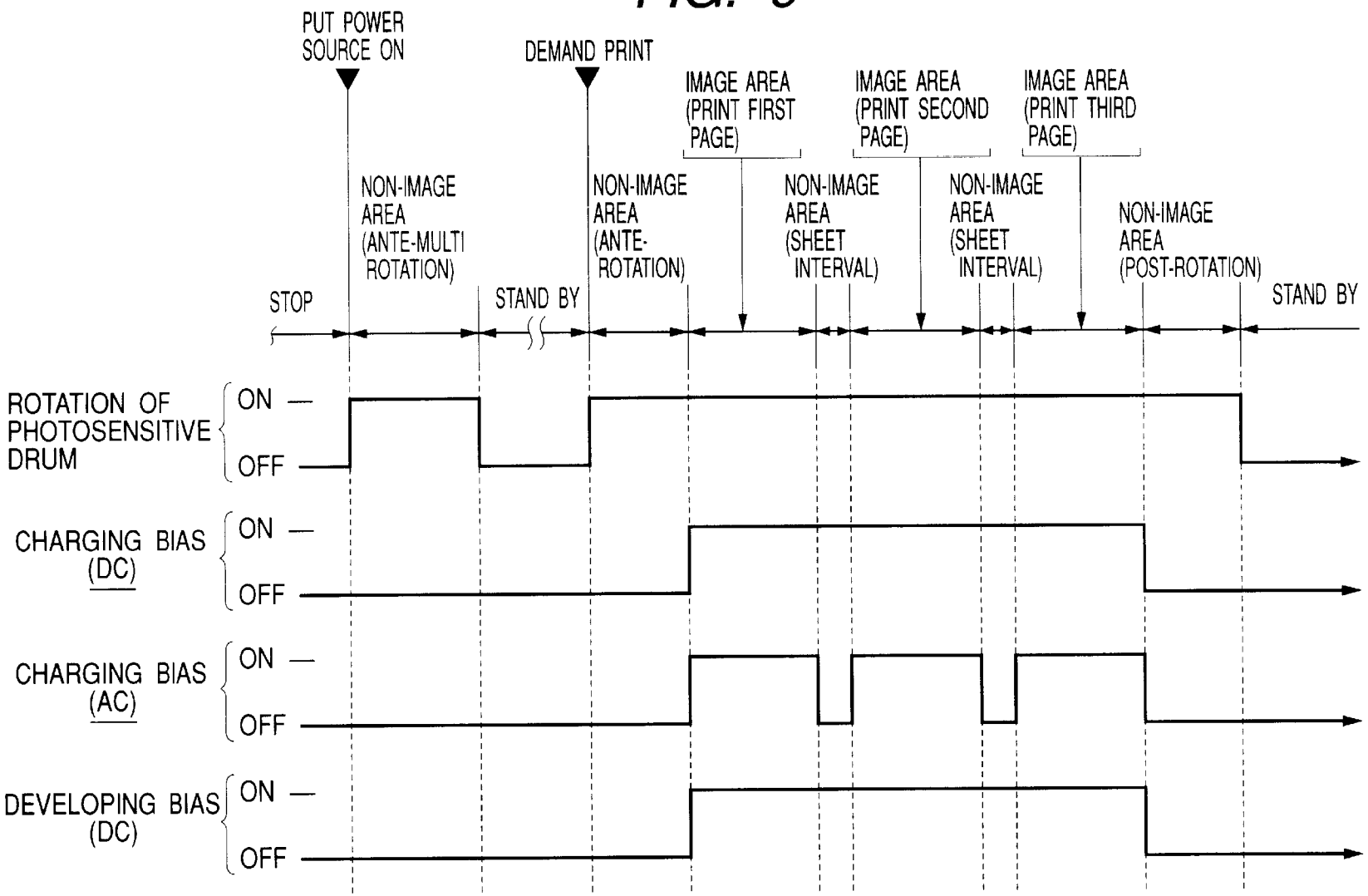
FIG. 9 is a schematic diagram showing control of a charging bias and a developing bias in an image area and a non-image area on a photosensitive body in accordance with the first embodiment of the present invention.

FIG. 9 is a schematic diagram showing control of a developing bias and a charging bias in a first area (corresponding to the length of the transferring material P, at the time of image formation) to be an image forming area and a second area (sheet interval in the drawing, at the time of non-image formation) to be a non-image forming area on the photosensitive drum 1 in this embodiment, which shows the case where a print request for sequential 3 sheets is provided.

In this embodiment, as the bias applied to the core metal 2*a* of the charging cleaning roller 2 by the charging bias application power source S1, in the image area at the time of image formation, the above-mentioned superimposed voltage by a direct current voltage and an alternating voltage is applied to the area including the length of the transferring material P while, in the non-image area (sheet interval) that is the area between the transferring materials at the time of non-image formation, only a direct current voltage is applied without applying an alternating voltage. Thus, the peripheral surface of the photosensitive drum 1 is charged.

Here, a direct current voltage of −700 V is applied to the core metal 2*a* of the charging cleaning roller 2 in the non-image area.

Further, the developing bias of −400 V is applied to the core metal of the developing roller 5*a* in both the image area and the non-image area in continuous image formation by the developing bias application power source S2.

COMPARATIVE EXAMPLE 1

Figure 10:
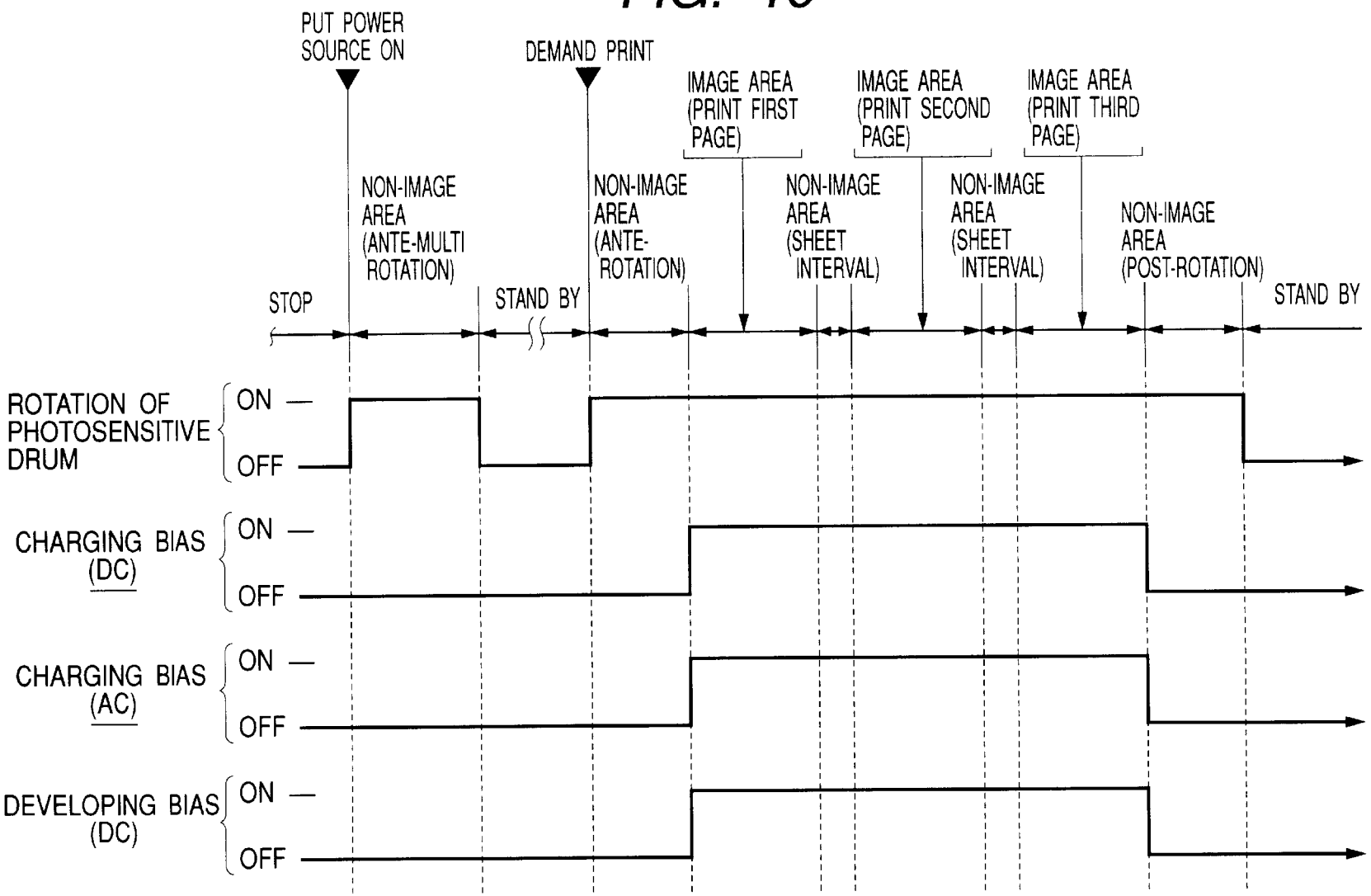
FIG. 10 is a schematic diagram showing control of a charging bias and a developing bias in an image area and a non-image area on a photosensitive body in accordance with Comparative Example 1.

Comparative Example 1 is the same as Embodiment 1, as shown in FIG. 10, except for the point that, in the image forming apparatus in this embodiment, a direct current voltage and an alternating voltage are superimposedly applied to both the image area and the non-image area in the continuous image formation, thereby charging the peripheral surface of the photosensitive drum 1.

COMPARATIVE EXAMPLE 2

Figure 11:
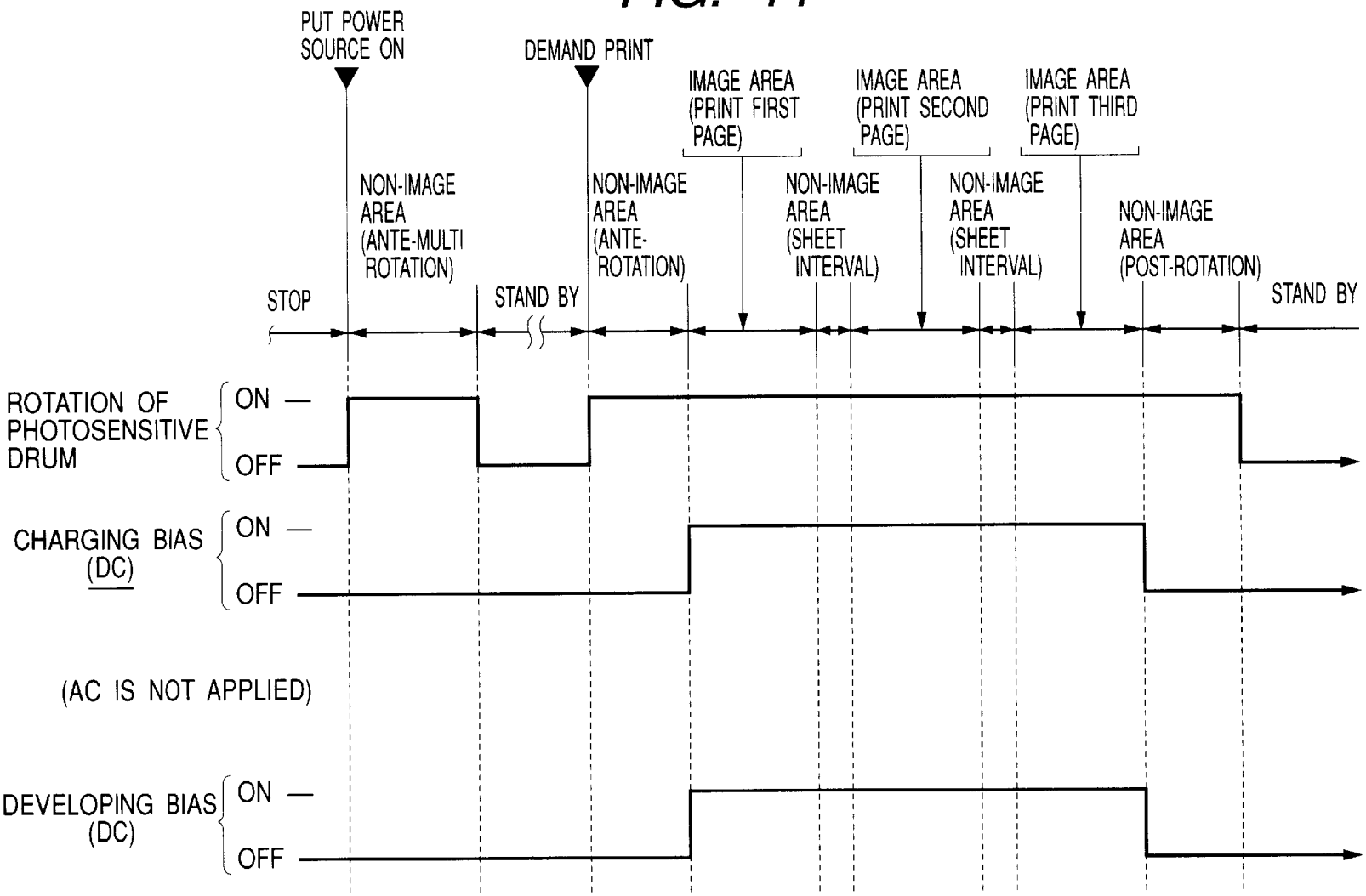
FIG. 11 is a schematic diagram showing control of a charging bias and a developing bias in an image area and a non-image area on a photosensitive body in accordance with Comparative Example 2.

Comparative Example 2 is the same as Embodiment 1, as shown in FIG. 11, except for the point that, in the image forming apparatus in this embodiment, only a direct current voltage (−700 V) is applied as the bias applied to the core metal 2*a* of the charging cleaning roller 2 without applying an alternating voltage, thereby charging the peripheral surface of the photosensitive drum 1 approximately at −700 V.

The evaluation result of the ghost image in the endurance test in the image forming apparatus in this embodiment and the respective comparative examples is shown in Table 1.

TABLE 1

| Image Forming Apparatus | After 100 Sheets | After 500 Sheets | At the Time of Completion of 1,000 Sheets |
|---|---|---|---|
| Embodiment 1 | ○ | ○ | ○ |
| Comparative Example 1 | ○ | Δ | x |
| Comparative Example 2 | x | x | x |

Here, a guiding principle in the evaluation is shown below.
The evaluation is made based on:
○: no image defect (no charging defect);
Δ: little rise of density due to the ghost image; and
x: large rise of density due to the ghost image.

In the image forming apparatus in this embodiment, the ghost image and other defect images were not caused until the time of completion of endurance for 1,000 sheets.

In Comparative Example 1, in observation at the time of completion of endurance for 100 sheets, the sticking amount of the toner to the charging cleaning roller 2 was small yet, and there occurred no problem on an image. However, at the time of completion of 500 sheets, the ghost image of longitudinal belt was generated, and the image density was increased in the originally halftone portion, which led to charging defect. Note that, at the time of completion of 1,000 sheets, the ghost image was degraded, and thus, a desirable halftone image cannot be obtained. Therefore, there occurred charging defect that the longitudinal belt portions have substantially solid (uniform) density.

In Comparative Example 2, the sticking amount of the toner to the charging cleaning roller 2 was large in the observation even at the time of completion of 100 sheets, and thus, there occurred charging defect in which the ghost image of longitudinal belt was generated on the image. After the completion of 500 sheets, the ghost image was degraded, and thus, a desirable halftone image cannot be obtained. Therefore, there occurred a charging defect that the longitudinal belt portions have substantially solid (uniform) density.

When the images of longitudinal belt pattern as shown in FIG. 8 are continuously formed, the transfer residual toner is continuously scraped in the image part of the charging cleaning roller 2 in the longitudinal direction. In the part, the amount of interposal of the cleaning supporting particles z becomes little relative to the amount of contamination due to the toner.

Particularly in the low temperature and low humidity environment in which securing of the charging property is difficult, it becomes difficult to secure the charging property if a predetermined amount of interposal of the cleaning supporting particles z, which are interposed in the charging nip portion n of the photosensitive drum 1 and the charging cleaning roller 2, is not secured.

Therefore, as shown in this embodiment, the second area to be the non-image area on the photosensitive drum 1 at the time of non-image formation is utilized, whereby a direct current voltage without an alternating voltage is applied to the charging cleaning roller 2. Thus, the potential difference between the surface of the photosensitive drum 1 and the charging cleaning roller 2 is made small. As a result, it is possible to reduce the expelling amount of the cleaning supporting particles z which indicates the movement of the particles with positive polarity. Therefore, the particles z can be preferably held on the charging cleaning roller 2 by supply from the cleaning supporting particle a supply means 3.

Further, in the case where the bias applied to the charging cleaning roller 2 is only a direct current voltage as in Comparative Example 2, it is difficult that the transfer residual toner is expelled as described above. Under the above severe condition, a charging defect image occurs even in the early stages of endurance.

Further, in the case where the bias applied to the charging cleaning roller 2 is a superimposed voltage by a direct current voltage and an alternating voltage as in Comparative Example 1, it is possible to expel the transfer residual toner, and the toner is not accumulated on the charging cleaning roller 2. However, the cleaning supporting particles z, which are interposed in the charging nip portion n of the photosensitive drum 1 and the charging cleaning roller 2, are also expelled. Thus, under the above severe condition, charging uniformity cannot be secured.

As described above, in the image forming apparatus in this embodiment, the cleaning supporting particles z are interposed in the contact portion n of the charging cleaning roller 2 and the photosensitive drum 1, and at the time of image formation, a superimposed voltage by a direct current voltage and an alternating voltage of which a peak to peak voltage is less than a charging potential convergence voltage is applied to the charging cleaning roller 2. Thus, the charging cleaning roller 2 is made to function as the charging cleaning member for scraping the transfer residual toner and charging the peripheral surface of the photosensitive drum 1 at a predetermined potential and for expelling the transfer residual toner to the downstream side in the rotational direction of the photosensitive drum 1, whereby contamination of the charging cleaning roller 2 is prevented.

Further, in a sheet interval corresponding to non-image formation period, only a direct current voltage is applied to the charging cleaning roller 2. Thus, the potential difference between the surface of the photosensitive drum 1 and the charging cleaning roller 2 is made small, whereby the amount of expelling of the cleaning supporting particles z can be reduced. Therefore, the particles z can be preferably held on the charging cleaning roller 2 by the supply from the cleaning supporting particle supply means 3.

Therefore, in the image forming apparatus of this embodiment, even under the above-described severe condition, while the contamination of the charging cleaning roller 2 as the contact charging means is prevented, a predetermined amount of the cleaning supporting particles z can be interposed in the contact portion n of the charging cleaning roller 2 and the photosensitive drum 1. Thus, the charging uniformity is secured, and it becomes possible to obtain output images with high quality and with little charging defect and fog over a long period of time.

On the other hand, in this embodiment, as shown in FIG. 9, a direct current voltage is applied to the charging cleaning roller 2 by utilizing the time for sheet interval corresponding to the non-image area, whereby the cleaning supporting particles z are held on the charging cleaning roller 2. However, it is also possible to utilize other time of non-image formation. For example, the ante-rotation process, the post-rotation process and the ante-multiple rotation process are utilized, whereby the cleaning supporting particles z can be supplied to and held on the charging cleaning roller 2. Optimization can be appropriately conducted in accordance with the ability of the image forming apparatus.

The above problem of a ghost image is similarly occurred in the case where bad conditions are provided such that the amount of the transfer residual toner scraped by the charging cleaning roller 2 exceeds a predetermined amount due to degradation of the transfer efficiency, jam, or the like. However, of course, the image forming apparatus in this embodiment is advantageous in securing the charging uniformity in comparison with the comparative examples.

Embodiment 2

Figure 12:
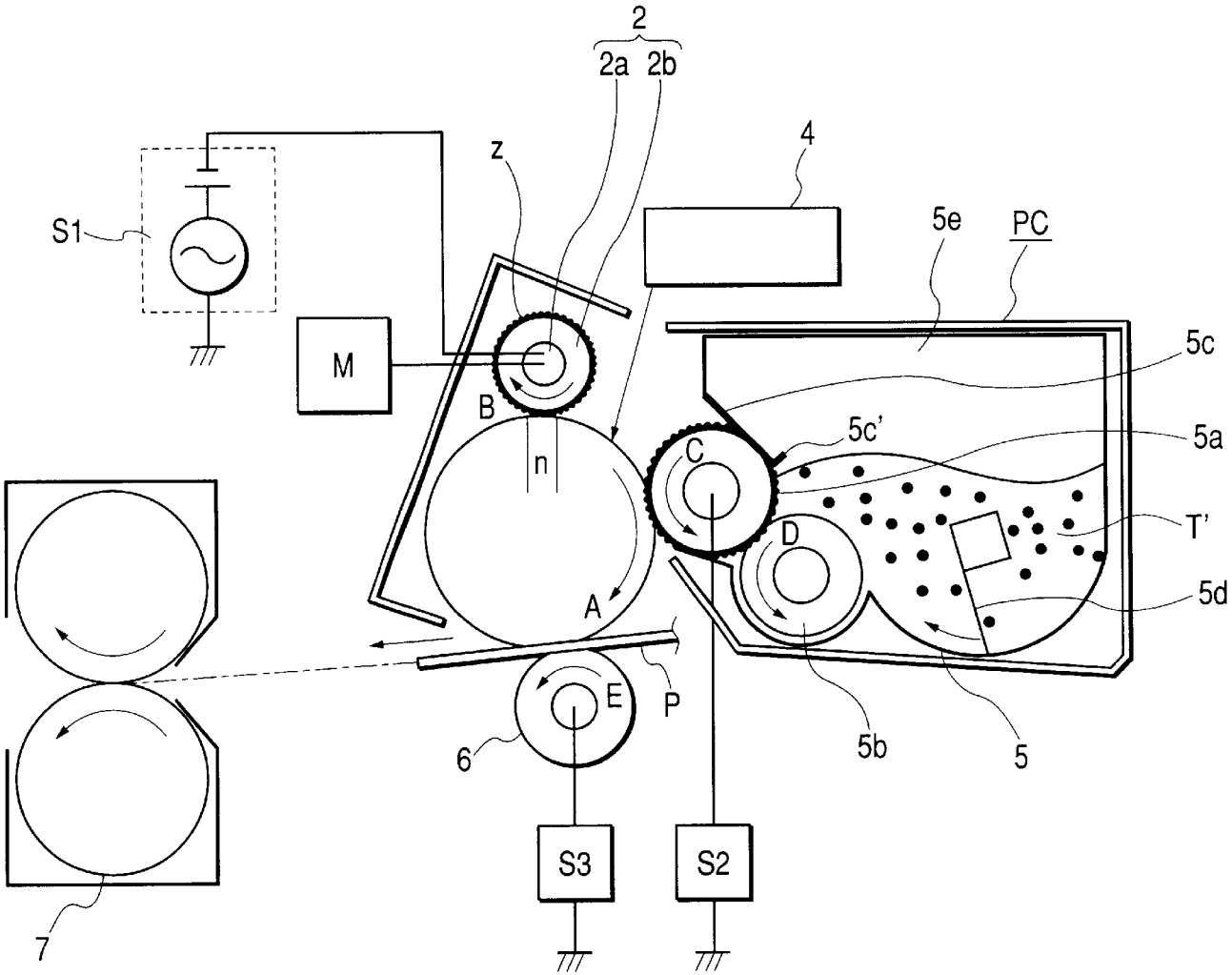
FIG. 12 is a structural diagram showing an outline of an image forming apparatus in accordance with the second embodiment of the present invention.

FIG. 12 is a structural diagram showing an outline of an image forming apparatus in accordance with this embodiment. In the image forming apparatus in this embodiment, the cleaning supporting particles z, which are supplied from the cleaning supporting particle supply means 3 in the image forming apparatus in Embodiment 1, are uniformly dispersed to the toner body by a mixing device, and are kept in the developing device 5 as a developer T'. The supply of the cleaning supporting particles z is conducted by the developing means, whereby the contamination of the charging cleaning roller 2 is prevented with a simple structure, and the cleaning simultaneous with developing is realized. Thus, it becomes possible to obtain output images with high quality and with little charging defect and fog over a long period of time. Here, it is desirable that the charging polarity of the particles z is opposite to the normal charging polarity of the toner and is opposite to the charging polarity of the charging cleaning roller 2.

Along with the above, among image forming elements, the photosensitive drum 1, the charging cleaning roller 2, and the developing device 5 containing the toner are integrated to obtain a process cartridge (PC) detachably attachable to the main body of the image forming apparatus. Thus, the frequency in accordance with various maintenance operations is reduced, a lot of trouble to a user is eliminated, and the improvement of usability is attained.

The same structural members and portions as in the image forming apparatus in Embodiment 1 are designated with same reference symbols, and second explanation therefor is omitted.

In the image forming apparatus in this embodiment, the cleaning supporting particle supply means 3 to the charging cleaning roller 2 in the image forming apparatus in Embodiment 1 is not provided, and the cleaning supporting particles z are uniformly dispersed to the toner body by the mixing device, and are kept in the toner storing container 5*e* of the developing device 5 as the developer T'.

In this embodiment, zinc oxide with resistivity of $10^6$ Ω·cm and with an average particle size of 1 μm is used for the cleaning supporting particles z. Then, zinc oxide as the cleaning supporting particles z of 2.0 parts by weight is added to the toner body of 100 parts by weight after classification which is used in Embodiment 1, and dispersion is uniformly conducted with the mixing device, thereby obtaining toner T'.

Further, the charging cleaning roller 2 is previously applied with the cleaning supporting particles z.

In this embodiment, as the charging bias applied to the charging cleaning roller 2, DC voltage: −700 V AC voltage: peak to peak voltage of 0.8 kV
Frequency of 1.8 kHz
sine wave are superimposedly applied. The charging bias is applied, whereby the peripheral surface of the photosensitive drum 1 is directly charged at a voltage (approximately −700 V) substantially equal to the applied DC voltage.

The structures of the image forming apparatus other than the above structure apply to the structure of the image forming apparatus in Embodiment 1.

The cleaning supporting particles z externally added to the toner T' that is the developer of the developing device 5 are mixed with the toner at the time of developing of the electrostatic latent image of the surface of the photosensitive drum 1 to be stuck to the surface of the photosensitive drum 1. Then, the toner image on the peripheral surface of the photosensitive drum 1 is positively transferred by being pulled to the transferring material P side due to the influence of the transfer bias in the transfer nip portion c.

The transfer residual toner remaining on the peripheral surface of the photosensitive drum 1 after transfer and the above cleaning supporting particles z are carried to the charging nip portion n of the photosensitive drum 1 and the charging cleaning roller 2 by the rotation of the photosensitive drum 1. The supply of the cleaning supporting particles z to the charging nip portion n and sticking and mixing of the cleaning supporting particles z to the charging cleaning roller 2 are occurred.

That is, contact charging of the photosensitive drum 1 is conducted in the state that the cleaning supporting particles z exist in the charging nip portion n formed by the photosensitive drum 1 and the charging cleaning roller 2.

Since the cleanerless structure is adopted in the image forming apparatus in this embodiment, a cleaner (cleaning apparatus) such as a cleaning blade is not arranged. The transfer residual toner is collected and reused by conducting cleaning simultaneous with developing in the developing device 5 with the action described in Embodiment 1 using FIG. 3. At this time, the cleaning supporting particles z separated from the charging nip portion n and from the charging cleaning roller 2 are also collected in the developing device 5 at the developing part b, and are mixed with the developer T' to be used in circulation.

Further, through the image forming operation, even if the cleaning supporting particles z are separated from the charging nip portion n and the charging cleaning roller 2, the cleaning supporting particles z contained in the developer T' of the developing device 5 move to the peripheral surface of the photosensitive drum 1 at the developing part b, and are continuously supplied to the charging nip portion n through the transfer nip portion c one after another by the movement of the peripheral surface of the photosensitive drum 1. Therefore, the cleaning supporting particles z continuously exist in the charging nip portion n, and the satisfactory charging property is stably maintained over a long period of time.

As described above, since the cleaning supporting particles z exist in the charging nip portion n, the frictional resistance of the photosensitive drum 1 and the charging cleaning roller 2 can be reduced due to the effect of the particles z as slip additive. Thus, the charging cleaning roller 2 can be made to contact the peripheral surface of the photosensitive drum 1 with effective speed difference without imparting an excessive load to the members abrasively slid with each other and to the driving source M.

Furthermore, the speed difference is provided between the charging cleaning roller 2 and the photosensitive drum 1, whereby the number of opportunities that the cleaning supporting particles z contact the photosensitive drum 1 in the charging nip portion n of the charging cleaning roller 2 and the photosensitive drum 1 is remarkably increased, thereby obtaining high contacting property.

Therefore, the cleaning supporting particles z that exist in the charging nip portion n of the charging cleaning roller 2 and the photosensitive drum 1 are abrasively slid on the peripheral surface of the photosensitive drum 1 with no gap, whereby charge can be directly injected to the photosensitive drum 1 with efficiency. Thus, in the contact charging of the photosensitive drum 1 by the charging cleaning roller 2, direct charging (injection charging) is dominant due to the interposal of the cleaning supporting particles z.

Here, as in Embodiment 1, evaluation is conducted based on an endurance test using the image forming apparatus in this embodiment as to the charging performance under the condition that securing of charging uniformity is difficult.

The evaluation condition is the same as in Embodiment 1, and in low temperature and low humidity environment (15° C./10%) where securing of the charging property is difficult, endurance test is performed with the image pattern in which longitudinal belts and blanks are combined as shown in FIG. 8, a half-tone image is output every passing of 100 sheets, and then, the occurrence level of a ghost image is evaluated. In the endurance test, passing of 1,000 sheets is conducted, thereby judging the charging performance.

Figure 13:
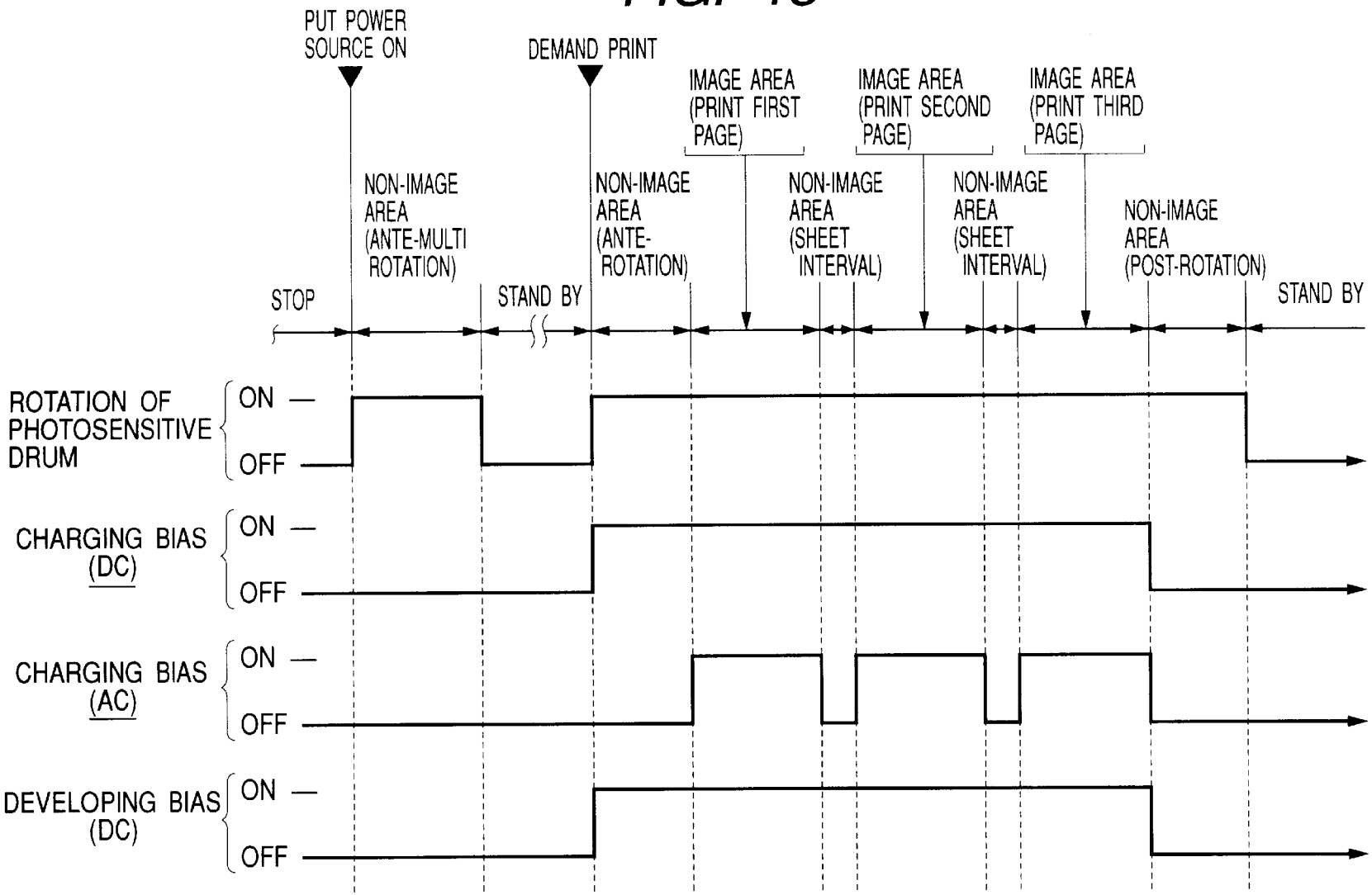
FIG. 13 is a schematic diagram showing control of a charging bias and a developing bias in an image area and a non-image area on a photosensitive body in accordance with the second embodiment of the present invention.

The control of the charging bias in continuous printing is conducted as shown in FIG. 13. That is, similarly to the control schematic diagram shown in FIG. 9, a direct current voltage and an alternating voltage are superimposedly applied to the first area to be the image area while only a direct current voltage is applied to the second area to be the non-image area (sheet interval), thereby charging the peripheral surface of the photosensitive drum 1. Further, in this embodiment, only a direct current voltage as the charging bias is also applied at the time of the ante-rotation and the post-rotation corresponding to the non-image area, thereby charging the peripheral surface of the photosensitive drum 1.

In the ante-rotation and the post-rotation, a bias of −400 V that is the same as the bias at the time of developing is applied as a developing DC bias in this embodiment.

The setting is made as described above, whereby, due to the potential difference between about −700 V on the charged peripheral surface of the photosensitive drum and the developing bias (−400 V), the negatively charged toner is not developed from the developing roller 5*a* to the surface of the photosensitive drum in the developing part b, and only the positively charged cleaning supporting particles z can be transferred. When the particles z carried on the surface of the photosensitive drum pass through the transferring part c and reach the charging nip portion n of the charging cleaning roller 2, they are caught by the hole of the roller 2 and are scraped from the surface of the photosensitive drum. Thus, the cleaning supporting particles (charging cleaning particles) z can be carried on the roller 2.

The evaluation result on the ghost image in the endurance test in the image forming apparatus of this embodiment is shown in the following Table 2.

TABLE 2

| Image Forming Apparatus | After 100 Sheets | After 500 Sheets | Time of Completion of 1,000 Sheets |
|---|---|---|---|
| Embodiment 2 | ○ | ○ | ○ |

Here, a guiding principle in the evaluation is shown as follows.
The evaluation is made based on:
○: no image defect (no charging defect);
Δ: little rise of density due to the ghost image; and
x: large rise of density due to the ghost image.

The evaluation is conducted in the image forming apparatus in this embodiment. As a result, the ghost image and other image defect are not occurred until the time of completion of endurance for 1,000 sheets. Further, in observation of the charging cleaning roller 2 at the time of completion of endurance, there is seen the satisfactory state that dirt due to toner is little and that the cleaning supporting particles z are appropriately held.

Note that, in the non-image area in the ante-rotation and the post-rotation, the developing bias is changed, whereby it is also possible to control the transfer amount of the cleaning supporting particles z to the surface of the photosensitive drum at the developing part b.

That is, while the charging surface of the photosensitive drum 1 that is the non-image area applied with a direct current voltage at the time of non-image formation passes the developing part b that is the abutting portion with the developing roller 5*a*, the developing bias for forming an electric field in which the cleaning supporting particles bias the charging surface is applied from at least the developing means. The potential difference is increased with respect to the image area, whereby the transfer amount of the particles z can be increased.

For example, the developing bias is changed from −400 V in the image area to −300 V in the non-image area. Thus, the potential difference is increased, whereby the transfer amount of the particles z can be increased.

Note that the potential difference may be appropriately determined taking fog into consideration.

Further, when the particles z carried on the surface of the photosensitive drum pass the transferring part c, the transfer bias, in which the particles z are difficult to be transferred to the transfer roller 6, may be applied from the bias power source S3.

By changing the above bias settings and application timing, the supply amount of the particles z to the changing cleaning roller 2 can be optimized in accordance with the image forming apparatus.

As described above, in the image forming apparatus in this embodiment, the cleaning supporting particles z are interposed in the contact portion n of the charging cleaning roller 2 and the photosensitive drum 1, and at the time of image formation, a direct current voltage and an alternating voltage of which a peak to peak voltage is less than a charging potential convergence voltage are superimposedly applied to the charging cleaning roller 2. Thus, the charging cleaning roller 2 is made to function as the charging cleaning member for scraping the transfer residual toner and charging the peripheral surface of the photosensitive drum 1 at a predetermined potential and for expelling the transfer residual toner to the downstream side in the rotational direction of the photosensitive drum 1, whereby the contamination of the charging cleaning roller 2 is prevented.

On the other hand, at the time of non-image formation, only a direct current voltage is applied to the charging cleaning roller 2. Thus, the expelling amount of the cleaning supporting particles z can be decreased by decreasing the potential difference between the surface of the photosensitive drum and the charging cleaning roller 2. Also, the particles z can be preferably held on the charging cleaning roller 2 by the supply of the cleaning supporting particles z from the developing device 5.

Thus, in the image forming apparatus in this embodiment, even in the use under the above-mentioned severe condition, the contamination of the charging cleaning roller 2 that is the contact charging means is prevented while an appropriate amount of the cleaning supporting particles z can be interposed in the contact portion n of the charging cleaning roller 2 and the photosensitive drum 1 that is the image bearing member. Thus, the charging property is secured, and it is possible to obtain output images with high quality and with little charging defect and fog over a long period of time.

Further, the cleaning supporting particles z are supplied from the developing device 5, whereby the contamination of the charging cleaning roller 2 can be prevented with a simple structure. Thus, the reduction in size and low cost of the apparatus can further be realized.

Furthermore, in the image forming apparatus in this embodiment, among image forming elements, the photosensitive drum 1, the charging cleaning roller 2, and the developing device 5 containing the developer T' are integrated to obtain a process cartridge (PC) detachably attachable to the main body of the image forming apparatus.

Therefore, labor of a user, which is accompanied by various maintenance operations such as toner replenishment and exchange of the photosensitive drum 1 of which the life is expired, is reduced, and thus, stable output images can be obtained with a simple operation.

Moreover, the cleaning supporting particles z are previously carried on the surface of the charging cleaning roller 2, whereby the direct charging performance can be exhibited without any trouble from the early stages of the use of a process cartridge.

The process cartridge is obtained by integrating the charging means, the developing means or cleaning means, and the image bearing member into a cartridge, and is detachably attachable to the main body of the image forming apparatus. Also, the process cartridge is obtained by integrating at least one of the charging means, the developing means and the cleaning means and the image bearing member into a cartridge, and is detachably attachable to the main body of the image forming apparatus. Further, the process cartridge is obtained by integrating at least developing means and the image bearing member into a cartridge, and is detachably attachable to the main body of the image forming apparatus.

Others

1) As a waveform of an alternating voltage component of the charging bias or developing bias, a sine wave, a rectangular wave, a triangular wave and the like can be appropriately used. Further, the rectangular wave formed by periodically putting on/off a direct current power source may also be used. As described above, the bias of which the voltage value periodically varies can be used as the waveform of the alternating voltage.
2) As an image exposure means for forming an electrostatic latent image, the present invention is not limited to a laser scanning exposure means for forming a digital latent image as in the embodiment. Other light emitting devices such as a general analog image exposure and an LED may also be adopted. Further, the image exposure means, in which a light emitting device of a fluorescent lamp or the like and a liquid crystal shutter are combined, and the like may be adopted. Any image exposure means may be used as long as the means can form an electrostatic latent image corresponding to image information.
3) The image bearing member 1 may be an electrostatic recording dielectric or the like. In this ease, the dielectric surface is uniformly primarily charged to predetermined polarity and potential, and then selectively charge-removed by a charge-removal means such as a charge-removal stylus head or an electronic gun, to thereby form a target electrostatic latent image on the dielectric surface.
4) In the above embodiments, the developing device 5 is described giving an example of the reversal developing device using the non-magnetic one-component toner as the developer. However, the structure of the developing device is not particularly limited. A normal developing device may be used.

Generally, methods of developing an electrostatic latent image are roughly divided into four types: a method of developing an electrostatic latent image in which non-magnetic toner is coated on a developer carrying and transferring member such as a sleeve by a blade or the like, or magnetic-toner is coated on the developer carrying and transferring member by a magnetic force and the non-magnetic toner or the magnetic toner is transferred to be applied to an image bearing member in a non-contact state (one-component non-contact developing); a method of developing an electrostatic latent image in which the toner coated on a developer carrying and transferring member is applied to an image bearing member in a contact state (one-component contact developing); a method of developing an electrostatic latent image in which toner particles mixed with magnetic carrier are used as a developer (two-component developer) and are transferred by a magnetic force to be applied to an image bearing member in a contact state (two-component contact developing); and a method of developing an electrostatic latent image in which the above two-component developer is applied to an image bearing member in a non-contact state (two-component non-contact developing).

The present invention is not limited to the above embodiments, and any modification can be applied in the scope of the technical ideas of the present invention.

What is claimed is:

1. An image forming apparatus comprising:

an image bearing member;

a flexible charging member for forming a nip portion with said image bearing member and for charging said image bearing member, said nip portion being provided with conductive particles; and developing means for developing an electrostatic image formed on said image bearing member with a developer, said developing means being capable of collecting a remaining developer on said image bearing member, wherein when a first area to be an image forming area of said image bearing member is present in said nip portion, a superimposed voltage resulting from a direct current voltage and an alternating voltage having a peak to peak voltage smaller than an alternating voltage applied when a charging potential of said image bearing member is converged is applied to said charging member, and wherein when a second area to be a non-image area of said image bearing member is present in said nip portion, a direct current voltage without an alternating voltage is applied to said charging member.

2. An image forming apparatus according to claim 1, wherein said charging member scrapes the developer on said image bearing member and expels the scraped developer to a downstream side of said nip portion in a moving direction of said image bearing member.

3. An image forming apparatus according to claim 1, wherein a foam layer is provided on a surface of said charging member.

4. An image forming apparatus according to claim 3, wherein said foam layer carries said conductive particles.

5. An image forming apparatus according to claim 1, wherein said conductive particles have a friction charging polarity that charges the developer with a normal charging polarity.

6. An image forming apparatus according to claim 1, wherein said conductive particles have a charging polarity opposite to a charging polarity of said charging member, which charges said image bearing member.

7. An image forming apparatus according to claim 1 or 2, wherein said charging member is rotatable in an opposite direction to a rotational direction of said image bearing member in said nip portion.

8. An image forming apparatus according to claim 1, wherein said charging member has a peripheral velocity different from a velocity of said image bearing member.

9. An image forming apparatus according to claim 1, wherein the peak to peak voltage is 500 V or higher.

10. An image forming apparatus according to claim 1 or 2, wherein the peak to peak voltage is less than 1,200 V.

11. An image forming apparatus according to claim 1, wherein a particle diameter of said conductive particles is in the range of 0.1 to 3 $\mu$m.

12. An image forming apparatus according to claim 1, wherein a resistance of said conductive particles is $10^{12}$ $\Omega$·cm or lower.

13. An image forming apparatus according to claim 1, wherein said developing means collects the remaining developer on said image bearing member simultaneously with a developing operation.

14. An image forming apparatus according to claim 1 or 13, further comprising:

transferring means for transferring an image formed on said image bearing member to a transferring member, and the developer remaining on said image bearing member after transfer by said transferring means reaches said nip portion.

15. An image forming apparatus according to claim 1, further comprising:

electrostatic image forming means for forming the electrostatic image on said image bearing member charged by said charging member.

16. An image forming apparatus according to claim 15, wherein said image bearing member includes a photosensitive body, and said electrostatic image forming means is an exposing means for exposing said photosensitive body.

17. An image forming apparatus according to claim 1, wherein said developing means includes a developer carrying member for carrying the developer, and said developer carrying member is provided so as to contact said image bearing member.

18. An image forming apparatus according to claim 1, wherein the developer is externally added with said conductive particles, and when said second area where the direct current voltage without the alternating voltage is applied to said charging member passes through a developing area, an electric field is formed in a direction that said conductive particles are transferred from said developing means to said image bearing member.

19. An image forming apparatus according to claim 1, wherein the developer used by said developing means has a shape factor SF-1 in the range of 100 to 150 and a shape factor SF-2 in the range of 100 to 140.

20. An image forming apparatus according to claim 1, wherein said image bearing member and said charging member are provided in a process cartridge that is detachably attachable to a main body of said apparatus.

21. An image forming apparatus according to claim 1, wherein said charging member is in a shape of a roller.

* * * * *

UNITED STATES PATENT AND TRADEMARK OFFICE

CERTIFICATE OF CORRECTION

PATENT NO. : 6,603,935 B2
DATED : August 5, 2003
INVENTOR(S) : Satoshi Tsuruya et al.

It is certified that error appears in the above-identified patent and that said Letters Patent is hereby corrected as shown below:

Column 2,
Line 31, “become” should read -- come --.

Column 9,
Line 48, “at” should read -- as --.

Column 15,
Line 22, “become” should read -- come --; and
Line 40, “considered” should read -- considered that --.

Column 16,
Line 47, “drum” should read -- drum 1. --.

Column 21,
Line 6, “is” should be deleted and “occurred” should read -- occurs --.

Signed and Sealed this

Thirteenth Day of January, 2004

JON W. DUDAS
*Acting Director of the United States Patent and Trademark Office*